US010323199B2

(12) United States Patent
Agarwal et al.

(10) Patent No.: US 10,323,199 B2
(45) Date of Patent: Jun. 18, 2019

(54) FUEL SUPPLEMENT TO REDUCE HARMFUL EMISSIONS

(71) Applicant: SSR Pharma Private Limited, Mumbai, Maharashtra (IN)

(72) Inventors: Sandeep P. Agarwal, Maharashtra (IN); Surjan Singh Rauthan, Maharashtra (IN)

(73) Assignee: SSR PHARMA PRIVATE LTD, Mumbai (IN)

( * ) Notice: Subject to any disclaimer, the term of this patent is extended or adjusted under 35 U.S.C. 154(b) by 0 days.

(21) Appl. No.: 15/394,060

(22) Filed: Dec. 29, 2016

(65) Prior Publication Data

US 2017/0107436 A1 Apr. 20, 2017

(30) Foreign Application Priority Data

Jul. 9, 2016 (IN) ..... 201621023550

(51) Int. Cl.

| | |
|---|---|
| ***C10L 1/18*** | (2006.01) |
| ***C10L 1/14*** | (2006.01) |
| *C10L 10/02* | (2006.01) |
| *C10L 1/16* | (2006.01) |
| *C10L 10/00* | (2006.01) |
| *C10L 10/08* | (2006.01) |

(52) U.S. Cl.

CPC ..... *C10L 1/1802* (2013.01); *C10L 1/14* (2013.01); *C10L 1/1616* (2013.01); *C10L 1/1691* (2013.01); *C10L 10/00* (2013.01); *C10L 10/02* (2013.01); *C10L 10/08* (2013.01); *C10L 2200/0423* (2013.01); *C10L 2200/0438* (2013.01); *C10L 2200/0469* (2013.01); *C10L 2270/023* (2013.01); *C10L 2270/026* (2013.01); *C10L 2290/06* (2013.01); *C10L 2290/24* (2013.01); *C10L 2290/547* (2013.01)

(58) Field of Classification Search

None

See application file for complete search history.

(56) References Cited

U.S. PATENT DOCUMENTS 7,220,289 B2 5/2007 Jordan
8,333,811 B2 12/2012 Hatziemmanouil
(Continued)

FOREIGN PATENT DOCUMENTS

CN 102925255 A 2/2013
EP 2215195 B1 7/2016
(Continued)

OTHER PUBLICATIONS

Derwent translation of IN201404073 (Year: 2014).*

*Primary Examiner* — Prem C Singh
*Assistant Examiner* — Ming Cheung Po
(74) *Attorney, Agent, or Firm* — Bio Intellectual Property Service LLC (Bio IPS); O. Sam Zaghmout

(57) ABSTRACT

The present invention relates to a Fuel Supplement comprising of selected plant oils mixed in given proportions, which when added to fuels like petrol and diesel can reduce harmful emissions during combustion of fuel. It can significantly decrease the Sulphur content in fuels and thus protect the environment from harmful pollutants. It improves the fuel lubricity and engine performance. It also increases the flash point of Diesel.

9 Claims, 9 Drawing Sheets

(56) References Cited

U.S. PATENT DOCUMENTS

Figure 1:
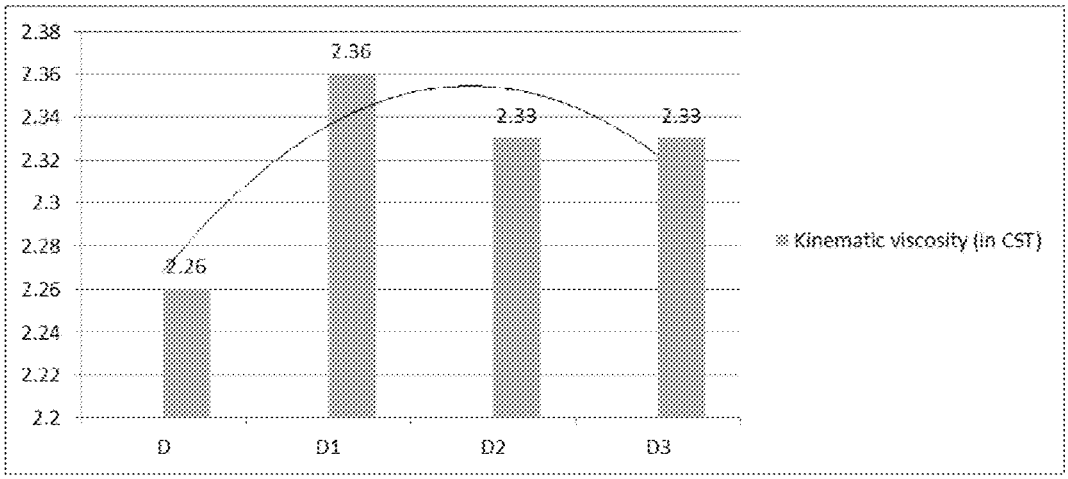

| | | | | |
|---|---|---|---|---|
| 8,439,986 | B2 * | 5/2013 | Theaker | C10L 1/02 44/308 |
| 9,476,005 | B1 | 10/2016 | Schuetzle et al. | |
| 9,487,717 | B2 | 11/2016 | Warnqvist | |
| 2016/0244687 | A1 | 8/2016 | Lai et al. | |

FOREIGN PATENT DOCUMENTS

| | | | | |
|---|---|---|---|---|
| IN | 201404073 | * | 12/2014 | |
| IN | 267145 | * | 7/2015 | |
| MX | 2008009601 | A | 9/2008 | |
| MX | 2008008128 | A | 10/2008 | |
| WO | WO-2004099352 | A2 * | 11/2004 | C08L 21/00 |

* cited by examiner

FUEL SUPPLEMENT TO REDUCE HARMFUL EMISSIONS

TECHNICAL FIELD OF THE INVENTION

This application claims the benefit of Indian patent application number 201621023550 filed on Jul. 9, 2016, the disclosure of which is incorporated herein by reference.

This invention relates to a Fuel Supplement composition comprising of plant oils, which when added to fuel like Petrol and Diesel, show significant reduction in Sulfur content and harmful emissions, thereby protecting the environment.

BACKGROUND

Petroleum is formed by hydrocarbons (a hydrocarbon is a compound made up of carbon and hydrogen) with the addition of certain other substances, primarily Sulfur. Petroleum in its natural form when first collected is usually named crude oil, and can be clear, green or black and may be either thin like gasoline or thick like tar.

The primary form of hydrocarbons in the Petroleum are the alkanes, which are also often named paraffins. These are termed saturated hydrocarbons and are very pure hydrocarbons that contain only hydrogen and carbon.

For fuel purposes only the alkanes from the following groups are used: Pentane and Octane are refined into gasoline, hexadecane and nonane is refined into kerosene or diesel or used as a component in the production of jet fuel.

The aromatic hydrocarbons are another form of unsaturated hydrocarbon. The specific difference between the other hydrocarbons in the petroleum molecule is that the aromatic hydrocarbons contain benzene rings, with atoms of hydrogen attached to them. Aromatic hydrocarbons tend to produce far more emissions when combusted, many have a sweet, sickly smell to them, hence the name aromatic hydrocarbons.

The composition of petroleum contains many trace elements—the key compounds are carbon (93%-97%), hydrogen (10%-14%), nitrogen (0.1%-2%), oxygen (01.%-1.5%) and sulfur (0.5%-6%) with a few trace metals making up a very small percentage of the petroleum composition.

Traditionally used fuels contain a complex mixture of hydrocarbons. They may also contain various additives, including detergents, anti-icing agents, emulsifiers, corrosion inhibitors, dyes, and deposit modifiers When such hydrocarbon fuels are combusted, a variety of pollutants are generated. These combustion products include ozone, particulates, carbon monoxide, nitrogen dioxide, sulfur dioxide, and lead.

During combustion, Sulfur combines with oxygen to produce Sulfur dioxide. Sulfur dioxide later combines with hydrogen in the atmosphere to produce the weak sulfurous acid as well as the strong sulfuric acid. Both of these contribute to acid rain. In addition to Sulfur, nitrogen is also a common contaminant in hydrocarbons. Nitrogen dioxide can react with hydrogen in the atmosphere to produce nitric acid, which also contributes to acid rain.

Sulfur is probably the most common and most well known petroleum contaminant. A concentration of just 0.5% Sulfur will make crude oil "sour," which means longer refining and more expensive gasoline and other products in the end. Most of this Sulfur is found in the form of hydrogen sulfide gas, a poisonous, noxious, foul-smelling gas sometimes called "sewer gas." Most hydrogen sulfide in petroleum results from the decay of organic matter.

Hydrogen sulfide is actually very flammable, so it could be used as a fuel if it were not for the fact that it is also deadly in relatively low concentrations. Hydrogen sulfide affects the nervous system, respiratory system, and may even have contributed to several mass extinctions in Earth's past. This deadly gas must be removed from petroleum in order to make it safer for use.

Highly refined or "lighter" fuels are more expensive than less refined or "heavier" fuels. They are more viscous and tend to burn. They are more prone to separation or sedimentation during transportation, blending or storage.

The less refined fuels contain a higher concentration of unstable components or compounds than highly refined fuels. Such components or compounds promote the formation of sediment or sludge within the fuel. Further, it is believed that such components or compounds lead to deleterious carbon formation on combustion, leading, to deposition on fuel injector, combustion and reduced efficiency in waste heat recovery.

The fuel cost is a major part of the total operating cost in any industry. Therefore there is often a strong economic driver to move to less refined fuels but the adverse consequences, mentioned above, inhibit it.

Blended fuels and different grades of conventional fuel oil may also suffer from problems of instability.

The most common type of diesel fuel is a specific fractional distillate of petroleum fuel oil, but alternatives that are not derived from petroleum, such as biodiesel, biomass to liquid (BTL) or gas to liquid (GTL) diesel, are increasingly being developed and adopted. To distinguish these types, petroleum-derived diesel is increasingly called Petrodiesel.

Ultra-low-sulfur diesel (ULSD) is a standard for defining diesel fuel with substantially lowered sulfur contents. As of 2016, almost all of the petroleum-based diesel fuel available in UK, Europe and North America is of a ULSD type.

Petroleum-derived diesel is composed of about 75% saturated hydrocarbons (primarily paraffins including n, iso, and cycloparaffins), and 25% aromatic hydrocarbons (including naphthalenes and alkylbenzenes). The average chemical formula for common diesel fuel is $C_{12}H_{23}$, ranging approximately from $C_{10}H_{20}$ to $C_{15}H_{28}$.

Most diesel fuels freeze at common winter temperatures, while the temperatures greatly vary. Petrodiesel typically freezes around temperatures of −8.1° C. (17.5° F.), whereas biodiesel freezes between temperatures of 2° to 15° C. (35° to 60° F.). The viscosity of diesel noticeably increases as the temperature decreases, changing it into a gel at temperatures of −19° C. (−2.2° F.) to −15° C. (5° F.), that cannot flow in fuel systems. Conventional diesel fuels vaporise at temperatures between 149° C. and 371° C. Conventional diesel flash points vary between 52 and 55° C., which makes it safer than petrol and unsuitable for spark-ignition engines.

In the past, diesel fuel contained higher quantities of Sulfur. European emission standards and preferential taxation have forced oil refineries to dramatically reduce the level of Sulfur in diesel fuels. In the European Union, the Sulfur content has dramatically reduced during the last 20 years. Automotive diesel fuel is covered in the European Union by standard EN 590. In the 1990s specifications allowed a content of 2000 ppm max of Sulphur, reduced to a limit of 350 ppm by the beginning of the 21st century with the introduction of Euro 3 specifications.

The limit was lowered with the introduction of Euro 4 by 2006 to 50 ppm (ULSD, Ultra Low Sulfur Diesel). The standard currently in force in European Europe for Diesel Fuel is the Euro 5, with a maximum content of 10 ppm.

In the United States, more stringent emission standards have been adopted with the transition to ULSD starting in 2006, and becoming mandatory on Jun. 1, 2010. U.S. diesel fuel typically also has a lower cetane number (a measure of ignition quality) than European diesel, resulting in worse cold weather performance and some increase in emissions.

High levels of Sulfur in diesel are harmful for the environment because they prevent the use of catalytic diesel particulate filters to control diesel particulate emissions, as well as more advanced technologies, such as nitrogen oxide ($NO_x$) adsorbers (still under development), to reduce emissions. Moreover, Sulfur in the fuel is oxidized during combustion, producing Sulfur dioxide and Sulfur trioxide, that in presence of water rapidly convert to sulfuric acid, one of the chemical processes that results in acid rain. However, the process for lowering Sulfur also reduces the lubricity of the fuel, meaning that additives must be put into the fuel to help lubricate engines. Biodiesel and biodiesel/petrodiesel blends, with their higher lubricity levels, are increasingly being utilized as an alternative.

A biofuel is a fuel that is produced through contemporary biological processes, such as agriculture and anaerobic digestion, rather than a fuel produced by geological processes such as those involved in the formation of fossil fuels, such as coal and petroleum, from prehistoric biological matter.

Biofuels can be derived directly from plants, or indirectly from agricultural, commercial, domestic, and/or industrial wastes. Renewable biofuels generally involve contemporary carbon fixation, such as those that occur in plants or microalgae through the process of photosynthesis. Other renewable biofuels are made through the use or conversion of biomass (referring to recently living organisms, most often referring to plants or plant-derived materials). This biomass can be converted to convenient energy-containing substances in three different ways: thermal conversion, chemical conversion, and biochemical conversion. This biomass conversion can result in fuel in solid, liquid, or gas form. This new biomass can also be used directly for biofuels.

Oils and fats can be hydrogenated to give a fuel substitute. The resulting product is a straight-chain hydrocarbon with a high cetane number, low in aromatics and Sulfur and does not contain oxygen. Hydrogenated oils can be blended with Fuel in all proportions. They have several advantages over biodiesel, including good performance at low temperatures, no storage stability problems and no susceptibility to microbial attack.

Edible oils such as soybean oil in the United States, rapeseed oil in Europe, palm oil in Malaysia are being used as raw material sources for biodiesel.

Many fuel additives are known in the Prior art which have beneficial properties like reduction in combustion, reduction in carbon formation giving deleterious effects but they may suffer from problems such as stability.

U.S. Pat. No. 7,220,289 provides a diesel fuel additive that includes a plant oil, beta carotene and Jojoba oil, to reduce emissions of undesired components during combustion of fuel. The additive may contain other components such as Octane Improvers, Cetane Improvers, Ignition Accelerators, Detergent Additives, Anti-oxidants, De-emulsifiers, Corrosion Inhibitors and Anti-wear Agents. The document also describes the extraction of plant oils through methods such as Solvent Extraction and Mechanical Pressing. To determine the ratio of the components, factors such as Elevation, Base fuel purity, type of fuel, etc have to be considered.

Thus the prior art involves a very tedious process of manufacture and too many variable parameters in determining the right ratio of ingredients.

U.S. Pat. No. 8,333,811 describes a method of refining vegetable oils, in particular Cottonseed oil, or a mixture of it with other oils, as a substitute of diesel fuel. It also contains an additive of organic basis containing ether, ketone, toluene, hexane, turpentine, alcohols in specific concentrations. Thus the prior art provides a non-corrosive, low flash point fuel with no residues and reduced friction wear. The process of manufacture of the same is lengthy and involves many treatment steps.

CN102925255 discloses an oil additive that contains an element substance extracted from Banana core. The extracted substance is added to the engine oil for lubrication, the sludge and carbon accumulated is decomposed. Carbon monoxide and hydrocarbons discharged are negligible thereby making it energy saving and environmentally friendly.

MX2008009601 discloses a Biodiesel fuel Additive composition and a method for decreasing the emissions from combustion of fuel that contains biodiesel. The composition may contain Meadowform oil or Jojoba oil.

The first component is an ignition accelerator and the second component is selected from a group of plant extracts. The fuel additive may contain a third component selected from group of long chain fatty acids, long chain fatty esters, and any combination thereof.

MX2008008128 describes a Residual Fuel Additive, for high asphaltene carbonaceous fuels such as residual fuel oil or coal, which provide improved combustion characteristics like improved efficiency and reduced emissions of pollutants.

The fuel additive contains an extract from plant such as fescue, alfeque or alfalfa.

EP2215195 discloses an Improved Process for preparation of Biodiesel from Vegetable Oils containing high FFA., especially oils such as Jatropha and Karanja. The invention involves a lengthy process of preparation involving liquid-liquid extraction, transesterification, neutralization and then purification.

U.S. Pat. No. 9,476,005 discloses a High Performance Diesel fuel Lubricity Additive, that are comprised of a mixture of one or more C3-C10 di-carboxylic acids with a mixture of one or more C3-C14 carboxylic acids that are blended in one or more C3-C16 hydroxy-alkanes. These additives may be produced by blending one or more C3-C14 carboxylic acids, C3-C10 di-carboxylic acids and C3-C16 hydroxy-alkanes, or by using various chemical synthesis procedures to directly produce mixtures of these classes of oxygenated aliphatic hydrocarbons.

US 2016244687 discloses a Diesel Fuel Additive, useful for reducing particulate matter emissions while improving or at least not aggravating oxidative stability during combustion. The additive includes at least one compound having a general formula selected from the group consisting of: and combinations thereof, wherein: R is a saturated or unsaturated hydrocarbon having from about 1 to about 6 carbons. The additive is effective in diesel at concentrations as low as from about 50 to about 1000 ppm by weight.

U.S. Pat. No. 9,487,717, discloses Process for obtaining a Diesel like Fuel, an enrichment method for obtaining components for the production of a diesel like fuel additive or a diesel like fuel from crude tall oil. In the method, lipophilic components, being present in said crude tall oil, are extracted with an organic solvent and the resulting extract is washed with sulfuric acid and water.

Indian Patent 267145, Automotive Fuel Additive Composition for Improving Efficiency of Fuel and Reducing Harmful Emissions with Exhaust and Process of manufacturing the same, discloses a fuel additive comprising of naturally occurring oils derived from plant or animal sources. The additive contains Clove oil, Shaal oil, Cinnamon oil, Nutmeg oil, Basil oil, Camphor oil, Castor oil, Basil aroma oil, Palash oil, Devdar oil, Rose red oil, Mint oil, Rosemary oil optionally with Aloevera oil, Balchand oil, Gandhpura oil, Jabakusum oil, Nirgundi oil, Olive oil and Wheat germ oil in definite proportions.

The dramatic rise in global warming has enhanced the need for finding alternative fuels or fuel additives or supplements which are eco-friendly and non-polluting.

Bharat Stage Emission Standards are emission standards instituted by the Government of India to regulate the output of air pollutants from internal combustion engine equipment, including motor vehicles. The standards and the timeline for implementation are set by the Central Pollution Control Board under the Ministry of Environment & Forests and climate change The standards, based on European regulations were first introduced in 2000. Progressively stringent norms have been rolled out since then. All new vehicles manufactured after the implementation of the norms have to be compliant with the regulations. Since October 2010, Bharat Stage (BS) III norms have been enforced across the country.

The phasing out of 2-stroke engine for two wheelers, the stoppage of production of cars such as Maruti 800 & introduction of electronic controls have been due to the regulations related to vehicular emissions.

While the norms help in bringing down pollution levels, it invariably results in increased vehicle cost due to the improved technology & higher fuel prices. However, this increase in private cost is offset by savings in health costs for the public, as there is lesser amount of disease causing particulate matter and pollution in the air. Exposure to air pollution can lead to respiratory and cardiovascular diseases, which is estimated to be the cause for 6.2 lakh early deaths in 2010, and the health cost of air pollution in India has been assessed at 3% of its GDP.

Indian Diesel specifications

| S. No | Characteristic | BSII | BSIII | BSIV | BSV | BSVI |
|---|---|---|---|---|---|---|
| 1 | Density kg/m3 15° C. | 820-800 | 820-845 | 820-845 | — | — |
| 2 | Sulphur Content mg/kg max | 500 | 350 | 50 | 10 | 10 |
| 3(a) | Cetane Number mini and/or | 48 | 51 | 51 | — | — |
| 3(b) | Cetane Index | or 46 | and 46 | and 46 | | |
| 4 | Polycyclic Aromatic Hydrocarbon | — | 11 | 11 | — | — |
| 5 | Distillation | | | | | |
| (a) | Reco Min At 350° C. | 85 | — | — | | |
| (b) | Reco Min At 370° C. | 95 | — | — | | |
| (c) | 95% Vol Reco at 0° C. | — | 360 | 360 | | |

Diesel Fuel Quality in India

| Date | Particulars |
|---|---|
| 1995 | Cetane number: 45; Sulfur: 1% |
| 1996 | Sulfur: 0.5% (Delhi + selected cities) |
| 1998 | Sulfur: 0.25% (Delhi) |
| 1999 | Sulfur: 0.05% (Delhi, limited supply) |
| 2000 | Cetane number: 48; Sulfur: 0.25% (Nationwide) |
| 2001 | Sulfur: 0.05% (Delhi + selected cities) |
| 2005 | Sulfur: 350 ppm (Euro 3; selected areas) |
| 2010 | Sulfur: 350 ppm (Euro 3; nationwide) |
| 2016 (proposed) | Sulfur: 50 ppm (Euro 4; major cities) |
| 2017 (proposed) | Sulfur: 50 ppm (Euro 4; nationwide) |
| 2020 (proposed) | Sulfur: 10 ppm (Euro 6; entire country) |

Diesel Vehicles: Mass Emission Standards (Effective from 1st April, 1996)

| Vehicle Category | HC* (g/kwhr) | CO* (g/kwhr) | Nox (g/kwhr) | Smoke in LAC |
|---|---|---|---|---|
| Medium & Heavy Over 3.5 T/GVW | 2.4 | 11.2 | 14.4 | |
| Light diesel upto 3.5 T/GVW | 2.4 | 11.2 | 14.4 | 2.3 |

It would be thus desirable to have an additive or a supplement composition which reduces or overcomes such problems while providing improved efficiency and is environment friendly.

The present invention overcomes the problems described above and provides a Fuel composition which can be used as a Fuel Supplement and has shown to significantly reduce harmful emissions generated upon combustion of the fuels.

The Fuel supplement can be mixed with base fuels such as Petrol and Diesel in a given ratio. The Fuel supplement is essentially a composition of Oils in a given proportion. The term oil as utilized herein refers to naturally occurring oils that are derived from plant sources.

OBJECTS OF THE INVENTION

The main objective of the present invention is to provide a Fuel Supplement that when added to fuels like petrol and diesel, reduces the Sulfur content and decreases the harmful emissions.

It is another objective of the present invention to provide a Fuel Supplement to reduce harmful emissions, which is prepared by combining naturally occurring oils derived from plant sources in a definite proportion and is thus environment friendly.

It is yet another objective of the invention to provide a Fuel Supplement to reduce harmful emissions, which is added to fuel like Petrol in a small ratio (10 ml to 12 ml per 1000 ml) and Diesel (13 ml to 15 ml per 1000 ml) to achieve the desired results.

Another objective of the present invention is to provide a Fuel Supplement to reduce harmful emissions, which reduces the Sulfur content in the Petrol by 70% to 80% and in Diesel by 40% to 50%.

It is yet another objective of the present invention to provide a Fuel Supplement to reduce harmful emissions, which when added to automotive fuels like Petrol and Diesel reduces the pollution and emissions from the vehicle by more than 70% to 80% (to meet Indian standards of PUC)

Another objective of the present invention to provide a Fuel Supplement which when added to automotive fuels like Diesel reduces the engine temperature by 5% to 10%

It is another objective of the present invention to provide a Fuel Supplement to reduce harmful emissions, which reduces the air pollution in the environment, thereby preventing the occurrence of allergic diseases like asthma, skin allergies and conjunctivitis, as well as other pollution related respiratory and cardiovascular diseases.

It is yet another objective of the present invention to provide a Fuel Supplement to reduce harmful emissions, which by preventing harmful hydrocarbon emissions, helps in reducing the effect of global warming. It will also help in agriculture and plantation as well as food supply.

Another objective of the present invention is to provide a Fuel Supplement to reduce harmful emissions, which improves fuel lubricity and thereby improves engine performance.

It is yet another objective of the present invention to provide a Fuel Supplement to reduce harmful emissions, to increase the flash point of the Diesel fuel from 55° C. to 65° C., which makes it beneficial for use in hotter climatic countries like Africa, Middle East Countries and even some parts of India.

SUMMARY OF THE INVENTION

According to the present invention, there is provided a Fuel Supplement to reduce harmful emissions, which essentially comprises of naturally occurring oils derived from plant sources in a definite proportion and a process of manufacture of the Fuel Supplement.

According to a preferred embodiment of the invention, there is provided a Fuel Supplement to reduce harmful emissions, for Petrol, containing the following plant oils in a given proportion:

Dust of Thymol (extracted from *Thymus vulgaris*)
Dust of Camphor White (extracted from *Cinnamomum Camphora*)
Dust of Mint (extracted from *Mentha arvensis*)
Neem Oil (*Azadirachta Indica*)
Banyan Leaf Oil (*Ficus benghalensis*)
Ashoka Leaf Oil (*Saraca asoca*)
Linseed Oil (*Linum usitatissimum*)
Clove Oil (*Eugenia cayophyllata*)
Lemongrass Oil (*Cymbopogan flexuosus*)
Indian Bay Leaf Oil (*Cinnamomum tamala*)
Jojoba Oil (*Simmondsia chenesis*)
Teak Oil (*Tectona grandis*)
Turmeric Oil (*Curcuma longa*)
Cedarwood Oil (*Cedrus atlantica*)
Turpentine Oil (*Pinus roxburghii*)
Coconut Oil (*Cocus nucifera*)
Sunflower Oil (*Helianthus annus*)
Peepal Leaf oil (*Ficus religiosa*)
Basil Leaf Oil (*Ocimum basilicum*)
White Cedar Leaf Oil (*Thuja occidentalis*)
Lemon *Eucalyptus* Oil (*Corymbia citriodora*)
Sheesham Oil (*Dalbergia sissoo*)
Olive Oil (*Olea europaea*)
Key Lime Oil (*Citrus aurantifolia*)
Khella Oil (*Ammi visagna*)
Indian Bael Leaf Oil (*Aegle marmelos*)

Accordingly in the preferred aspect of the invention, there is provided a process of manufacture of the Fuel Supplement to reduce harmful emissions, involving the following steps:

a) Mixing Dust of Thymol, Dust of Camphor White and Dust of Mint in specified range in 100 ml of Petrol;
b) Slowly adding of above mentioned oils in given order to the above prepared mixture,
to make 1000 ml of the Fuel Supplement composition, by gentle stirring and maintaining the temperature between 16 to 24° C.;
c) Filtering the Fuel Supplement composition to remove any impurities or particulate matter;
d) Warming the Fuel Supplement composition in a closed metallic container in water at temperature of 40 to 60° C., for 60 to 90 minutes;
e) Cooling the Fuel Supplement composition without stirring to temperature of 16 to 24° C. for 45 to 60 minutes; and
f) Filtering the Fuel Supplement composition and packing in aluminium or amber coloured glass bottles.

According to a preferred embodiment of the invention, there is provided a Fuel Supplement to reduce harmful emissions, for Diesel, containing the following plant oils in a given proportion:

Crystalline Thymol (extracted from *Thymus vulgaris*)
Crystalline Mint (extracted from *Mentha arvensis*)
Crystalline Camphor (*Cinnamomum Camphora*)
Cedarwood Oil (*Cedrus atlantica*)
Banyan Leaf Oil (*Ficus benghalensis*)
Turpentine Oil (*Pinus roxburghii*)
Groundnut Oil (*Arachis hypogaea*)
Liquid Paraffin Oil
Linseed Oil (*Linum usitatissimum*)
Indian Bay Leaf Oil (*Cinnamomum tamala*)
Clove Oil (*Eugenia cayophyllata*)
Khella Oil (*Ammi visagna*)
Indian Bael Leaf Oil (*Aegle marmelos*)
Key Lime Oil (*Citrus aurantifolia*)
Jojoba Oil (*Simmondsia chenesis*)
Olive Oil (*Olea europaea*)
Teak Oil (*Tectona grandis*)
Sheesham Oil (*Dalbergia sissoo*)
Sunflower Oil (*Helianthus annus*)
*Eucalyptus* Oil (*Corymbia citriodora*)
Lemongrass Oil (*Cymbopogan flexuosus*)
Basil Leaf Oil (*Ocimum basilicum*)
White Cedar Leaf Oil (*Thuja occidentalis*)
Turmeric Oil (*Curcuma longa*)
Lemongrass Oil (*Cymbopogon citratus*)

Accordingly in the preferred aspect of the invention, there is provided a process of manufacture of the Fuel Supplement to reduce harmful emissions, involving the following steps:

a) Mixing Crystalline Thymol, Crystalline Mint and Crystalline Camphor in specified range in 100 ml of Diesel;
b) Slowly adding of above mentioned oils in given order to the above prepared mixture,
to make 1000 ml of the Fuel Supplement composition, by gentle stirring and maintaining the temperature between 18 to 24° C.;
c) Filtering the Fuel Supplement composition to remove any impurities or particulate matter;
d) Warming the Fuel Supplement composition in a closed metallic container in water at temperature of 40 to 60° C., for 45 to 90 minutes;
e) Cooling the Fuel Supplement composition without stirring to temperature of 16 to 24° C. for 45 to 60 minutes; and
f) Filtering the Fuel Supplement composition and packing in aluminium or amber coloured glass bottles.

Accordingly, the present invention provides a Fuel Supplement to reduce harmful emissions, which is added to fuel like Petrol and Diesel in a small ratio to achieve the desired results. (10 ml to 12 ml per 1000 ml of Petrol and 13 ml to 15 ml per 1000 ml of Diesel)

According to a preferred embodiment of the present invention, there is provided a Fuel Supplement to reduce harmful emissions, which reduces the Sulphur content in the Petrol by 70% to 80% and in Diesel by 40% to 50%

According to yet another aspect of the present invention, a Fuel Supplement to reduce harmful emissions, is provided, which when added to automotive fuels like Petrol and Diesel reduces the pollution and emissions from the vehicle by 70% to 80% (to meet Indian standards of PUC)

According to an aspect of the present invention, a Fuel Supplement to reduce harmful emissions, when added to automotive fuels like Diesel reduces the engine temperature by 5% to 10%

Accordingly, the present invention provides a Fuel Supplement to reduce harmful emissions, which reduces the air pollution in the environment, thereby preventing the occurrence of allergic diseases like asthma, skin allergies and conjunctivitis, as well as other pollution related respiratory and cardiovascular diseases.

According to an aspect of the present invention, a Fuel Supplement to reduce harmful emissions, which by preventing harmful hydrocarbon emissions, helps in reducing the effect of global warming.

According to an aspect of the present invention, a Fuel Supplement to reduce harmful emissions, there is improved fuel lubricity and thereby improved engine performance.

According to another aspect of the present invention, a Fuel Supplement to reduce harmful emissions, there is significant increase the flash point of the Diesel fuel from 55° C. to 65° C., which makes it beneficial for use in hotter climatic countries like Africa, Middle East Countries and even some parts of India.

DETAILED DESCRIPTION OF THE INVENTION

The present invention relates to a Fuel Supplement composition comprising of plant oils, which when added to fuel like petrol and diesel, show significant reduction in Sulfur content and harmful emissions, thereby protecting the environment.

The preferred embodiment of the present invention of a Fuel Supplement to reduce harmful emissions, for Petrol, contains the following plant oils in a given proportion:

Dust of Thymol (extracted from *Thymus vulgaris*) in the range of 50 to 125 mg

Dust of Camphor White (extracted from *Cinnamomum Camphora*) in the range of 100 to 180 mg Dust of Mint (extracted from *Mentha arvensis*) in the range of 130 to 210 mg Neem Oil (*Azadirachta Indica*) in the range of 8 to 22 ml v/v Banyan Leaf Oil (*Ficus benghalensis*) in the range of 5 to 15 ml v/v Ashoka Leaf Oil (*Saraca asoca*) in the range of 4 to 16 ml v/v Linseed Oil (*Linum usitatissimum*) in the range of 15 to 25 ml v/v Clove Oil (*Eugenia cayophyllata*) in the range of 2 to 10 ml v/v Lemongrass Oil (Cymbopogan *flexuosus*) in the range of 10 to 35 ml v/v Indian Bay Leaf Oil (*Cinnamomum tamala*) in the range of 1 to 5 ml v/v Jojoba Oil (*Simmondsia chenesis*) in the range of 40 to 60 ml v/v Teak Oil (Tectona *grandis*) in the range of 50 to 75 ml v/v Turmeric Oil (*Curcuma longa*) in the range of 0.5 to 5 ml v/v Cedarwood Oil (*Cedrus atlantica*) in the range of 1 to 10 ml v/v Turpentine Oil (*Pinus roxburghii*) in the range of 60 to 100 ml v/v Coconut Oil (*Cocus nucifera*) in the range of 80 to 100 ml v/v Sunflower Oil (*Helianthus annus*) in the range of 30 to 80 ml v/v Peepal Leaf oil (*Ficus religiosa*) in the range of 35 to 50 ml v/v Basil Leaf Oil (*Ocimum basilicum*) in the range of 1 to 9 ml v/v White Cedar Leaf Oil (*Thuja occidentalis*) in the range of 10 to 30 ml v/v Lemon *Eucalyptus* Oil (*Corymbia citriodora*) in the range of 0.5 to 3.5 ml v/v Sheesham Oil (*Dalbergia sissoo*) in the range of 15 to 27 ml v/v Olive Oil (*Olea europaea*) in the range of 50 to 70 ml v/v Key Lime Oil (*Citrus aurantifolia*) in the range of 6 to 12 ml v/v Khella Oil (*Ammi visagna*) in the range of 10 to 18 ml v/v Indian Bael Leaf Oil (*Aegle marmelos*) in the range of 15 to 20 ml v/v As per the preferred embodiment of the invention, the process of manufacture of a Fuel Supplement to reduce harmful emissions, involves the following steps:

a) Mixing Dust of Thymol, Dust of Camphor White and Dust of Mint in specified range in 100 ml of Petrol;
b) Slowly adding of above mentioned oils in given order to the above prepared mixture, to make 1000 ml of the Fuel Supplement composition, by gentle stirring and maintaining the temperature between 16 to 24° C.;
c) Filtering the Fuel Supplement composition to remove any impurities or particulate matter;
d) Warming the Fuel Supplement composition in a closed metallic container in water at temperature of 40 to 60° C., for 60 to 90 minutes;
e) Cooling the Fuel Supplement composition without stirring to temperature of 16 to 24° C. for 45 to 60 minutes; and
f) Filtering the Fuel Supplement composition and packing in aluminium or amber coloured glass bottles.

The preferred embodiment of the present invention of a Fuel Supplement to reduce harmful emissions, for Diesel, contains the following plant oils in a given proportion:

Crystalline Thymol (extracted from *Thymus vulgaris*) in the range 40 to 60 mg

Crystalline Mint (extracted from *Mentha arvensis*) in the range of 200 to 260 mg Crystalline Camphor (*Cinnamomum Camphora*) in the range of 125 to 156 mg Cedarwood Oil (*Cedrus atlantica*) in the range of 18 to 26 ml v/v Banyan Leaf Oil (*Ficus benghalensis*) in the range of 15 to 30 ml v/v Turpentine Oil (*Pinus roxburghii*) in the range of 32 to 52 ml v/v Groundnut Oil (*Arachis hypogaea*) in the range of 16 to 22 ml v/v Liquid Paraffin Oil in the range of 17 to 30 ml v/v Linseed Oil (*Linum usitatissimum*) in the range of 7 to 16 ml v/v Indian Bay Leaf Oil (*Cinnamomum tamala*) in the range of 60 to 75 ml v/v Clove Oil (*Eugenia cayophyllata*) in the range of 25 to 35 ml v/v Khella Oil (*Ammi visagna*) in the range of 50 to 72 ml v/v
Indian Bael Leaf Oil (*Aegle marmelos*) in the range of 9 to 20 ml v/v
Key Lime Oil (*Citrus aurantifolia*) in the range of 2 to 6 ml v/v
Jojoba Oil (*Simmondsia chenesis*) in the range of 5 to 6.5 ml v/v
Olive Oil (*Olea europaea*) in the range of 40 to 56 ml v/v
Teak Oil (Tectona *grandis*) in the range of 29 to 42 ml v/v
Sheesham Oil (*Dalbergia sissoo*) in the range of 7 to 10 ml v/v
Sunflower Oil (*Helianthus annus*) in the range of 9 to 21 ml v/v
*Eucalyptus* Oil (*Corymbia citriodora*) in the range of 35 to 50 ml v/v
Lemongrass Oil (*Cymbopogan citratus*) in the range of 20 to 38 ml v/v
Basil Leaf Oil (*Ocimum basilicum*) in the range of 50 to 62 ml v/v
White Cedar Leaf Oil (*Thuja occidentalis*) in the range of 24 to 32 ml v/v
Turmeric Oil (*Curcuma longa*) in the range of 20 to 28 ml v/v As per the preferred embodiment of the invention, the process of manufacture of a Fuel Supplement to reduce harmful emissions, involves the following steps:

a) Mixing Crystalline Thymol, Crystalline Mint and Crystalline Camphor in specified range in 100 ml of Diesel;
b) Slowly adding of above mentioned oils in given order to the above prepared mixture, to make 1000 ml of the Fuel Supplement composition, by gentle stirring and maintaining the temperature between 18 to 24° C.;
c) Filtering the Fuel Supplement composition to remove any impurities or particulate matter;
d) Warming the Fuel Supplement composition in a closed metallic container in water at temperature of 40 to 60° C., for 45 to 90 minutes;
e) Cooling the Fuel Supplement composition without stirring to temperature of 16 to 24° C. for 45 to 60 minutes; and
f) Filtering the Fuel Supplement composition and packing in aluminium or amber coloured glass bottles.

An important feature of the present invention of a Fuel Supplement to reduce harmful emissions, is that only a small quantity (10 ml to 12 ml per 1000 ml of Petrol and 13 ml to 15 ml per 1000 ml of Diesel) of the Supplement needs to be added to the fuels like Petrol and Diesel, to achieve the desired results.

Yet another feature of the present invention of a Fuel Supplement to reduce harmful emissions, is that when added to fuel like Petrol, it reduces the Sulphur content in the Petrol by 70% to 80% and in Diesel by 40% to 50%

Another important feature of the present invention of a Fuel Supplement to reduce harmful emissions, is that when added to automotive fuels like Petrol and Diesel, it reduces the pollution and emissions from the vehicle by 70% to 80% (to meet Indian standards of PUC)

Another feature of the present invention of a Fuel Supplement to reduce harmful emissions, which when added to automotive fuels like petrol reduces the engine temperature by 5% to 10%

In yet another important feature of the present invention of a Fuel Supplement to reduce harmful emissions, there is reduction in the air pollution in the environment, thereby preventing the occurrence of allergic diseases like asthma, skin allergies and conjunctivitis, as well as other pollution related respiratory and cardiovascular diseases.

Another important feature of the present invention, a Fuel Supplement to reduce harmful emissions, is by preventing harmful hydrocarbon emissions; it helps in reducing the effect of global warming.

An important feature of the present invention, a Fuel Supplement to reduce harmful emissions, is improved fuel lubricity and thereby improved engine performance.

Yet another feature of the present invention, a Fuel Supplement to reduce harmful emissions, is significant increase the flash point of the Diesel fuel from 55° C. to 65° C., which makes it beneficial for use in hotter climatic countries like Africa, Middle East Countries and even some parts of India.

The present invention, Fuel Supplement to reduce harmful emissions, thus offers significant advantages like Reduction in harmful emissions thereby reduction in environmental pollution
Decrease in Sulphur content of fuels like petrol
Significant reduction in pollutants from exhaust gases
Reduction in engine temperature
Prevention of allergic diseases like allergic asthma, skin allergies, conjunctivitis
Prevention of pollution related respiratory and cardiovascular diseases
Improved Fuel lubricity and engine performance
Significant increase in flash point
By preventing harmful emissions, helps in reducing effects of global warming
Helps in better agricultural yields and food supply due to less CO2 content
Consists of naturally occurring plant oils and thus cost effective, safe and environment friendly
Simple process of manufacture

EXAMPLES

The efficacy of the present invention was tested by using different proportions of the naturally occurring plant oils which is illustrated in the examples given below Petrol Supplement:

Example 1

Dust of Thymol (extracted from *Thymus vulgaris*) in the range of 50 to 125 mg,

Dust of Camphor White (extracted from *Cinnamomum Camphora*) in the range of 100 to 180 mg and Dust of Mint (extracted from *Mentha arvensis*) in the range of 130 to 210 mg is mixed in 100 ml of Petrol.

Then following oils in given order are slowly added to the above prepared mixture

| | |
|---|---|
| Neem Oil (*Azadirachta Indica*) | 8 to 22 ml v/v |
| Banyan Leaf Oil (*Ficus benghalensis*) | 5 to 15 ml v/v |
| Ashoka Leaf Oil (*Saraca asoca*) | 4 to 16 ml v/v |
| Linseed Oil (*Linum usitatissimum*) | 15 to 25 ml v/v |
| Clove Oil (*Eugenia cayophyllata*) | 2 to 10 ml v/v |
| Lemongrass Oil (*Cymbopogan flexuosus*) | 10 to 35 ml v/v |
| Indian Bay Leaf Oil (*Cinnamomum tamala*) | 1 to 5 ml v/v |
| Jojoba Oil (*Simmondsia chenesis*) | 40 to 60 ml v/v |
| Teak Oil (*Tectona grandis*) | 50 to 75 ml v/v |
| Turmeric Oil (*Curcuma longa*) | 0.5 to 5 ml v/v |
| Cedarwood Oil (*Cedrus atlantica*) | 1 to 10 ml v/v |
| Turpentine Oil (*Pinus roxburghii*) | 60 to 100 ml v/v |
| Coconut Oil (*Cocus nucifera*) | 80 to 100 ml v/v |
| Sunflower Oil (*Helianthus annus*) | 30 to 80 ml v/v |
| Peepal Leaf oil (*Ficus religiosa*) | 35 to 50 ml v/v |
| Basil Leaf Oil (*Ocimum basilicum*) | 1 to 9 ml v/v |

-continued

| | |
|---|---|
| White Cedar Leaf Oil (*Thuja occidentalis*) | 10 to 30 ml v/v |
| Lemon *Eucalyptus* Oil (*Corymbia citriodora*) | 0.5 to 3.5 ml v/v |
| Sheesham Oil (*Dalbergia sissoo*) | 15 to 27 ml v/v |
| Olive Oil (*Olea europaea*) | 50 to 70 ml v/v |
| Key Lime Oil (*Citrus aurantifolia*) | 6 to 12 ml v/v |
| Khella Oil (*Ammi visagna*) | 10 to 18 ml v/v |
| Indian Bael Leaf Oil (*Aegle marmelos*) | 15 to 20 ml v/v |

to make 1000 ml of the Fuel Supplement composition, by gentle stirring and maintaining the temperature between 16 to 24° C. The mixture is then filtered to remove any impurities or particulate matter. The composition is warmed in a closed metallic container in water at temperature of 40 to 60° C., for 60 to 90 minutes after which it is cooled without stirring to temperature of 16 to 24° C. for 45 to 60 minutes. The final step is filtering the Fuel Supplement composition and packing in aluminium or amber coloured glass bottles.

Test results are given in Table 1

Example 2

Dust of Thymol (extracted from *Thymus vulgaris*) in the range of 50 to 80 mg, Dust of Camphor White (extracted from *Cinnamomum Camphora*) in the range of 80 to 120 mg and Dust of Mint (extracted from *Mentha arvensis*) in the range of 140 to 180 mg is mixed.

Then following oils in given order are slowly added to the above prepared mixture

| | |
|---|---|
| Neem Oil (*Azadirachta Indica*) | 18 to 20 ml v/v |
| Banyan Leaf Oil (*Ficus benghalensis*) | 2 to 7 ml v/v |
| Ashoka Leaf Oil (*Saraca asoca*) | 3 to 10 ml v/v |
| Linseed Oil (*Linum usitatissimum*) | 10 to 20 ml v/v |
| Clove Oil (*Eugenia cayophyllata*) | 8 to 10 ml v/v |
| Lemongrass Oil (*Cymbopogan flexuosus*) | 15 to 27 ml v/v |
| Indian Bay Leaf Oil (*Cinnamomum tamala*) | 0.5 to 3.5 ml v/v |
| Jojoba Oil (*Simmondsia chenesis*) | 20 to 30 ml v/v |
| Teak Oil (*Tectona grandis*) | 40 to 60 ml v/v |
| Turmeric Oil (*Curcuma longa*) | 1 to 4 ml v/v |
| Cedarwood Oil (*Cedrus atlantica*) | 3 to 9 ml v/v |
| Turpentine Oil (*Pinus roxburghii*) | 50 to 80 ml v/v |
| Coconut Oil (*Cocus nucifera*) | 70 to 80 ml v/v |
| Sunflower Oil (*Helianthus annus*) | 25 to 70 ml v/v |
| Peepal Leaf oil (*Ficus religiosa*) | 30 to 45 ml v/v |
| Basil Leaf Oil (*Ocimum basilicum*) | 2 to 8 ml v/v |
| White Cedar Leaf Oil (*Thuja occidentalis*) | 15 to 28 ml v/v |
| Lemon *Eucalyptus* Oil (*Corymbia citriodora*) | 1 to 3 ml v/v |
| Sheesham Oil (*Dalbergia sissoo*) | 17 to 25 ml v/v |
| Olive Oil (*Olea europaea*) | 45 to 65 ml v/v |
| Key Lime Oil (*Citrus aurantifolia*) | 2 to 10 ml v/v |
| Khella Oil (*Ammi visagna*) | 5 to 13 ml v/v |
| Indian Bael Leaf Oil (*Aegle marmelos*) | 10 to 15 ml v/v |

to make 1000 ml of the Fuel Supplement composition, by gentle stirring and maintaining the temperature between 16 to 24° C. The mixture is then filtered to remove any impurities or particulate matter. The composition is warmed in a closed metallic container in water at temperature of 40 to 60° C., for 60 to 90 minutes after which it is cooled without stirring to temperature of 16 to 24° C. for 45 to 60 minutes. The final step is filtering the Fuel Supplement composition and packing in aluminium or amber coloured glass bottles.

Test results are given in Table 1

Example 3

Dust of Thymol (extracted from *Thymus vulgaris*) in the range of 48 to 76 mg, Dust of Camphor White (extracted from *Cinnamomum Camphora*) in the range of 90 to 150 mg and Dust of Mint (extracted from *Mentha arvensis*) in the range of 160 to 200 mg is mixed.

Then following oils in given order are slowly added to the above prepared mixture

| | |
|---|---|
| Neem Oil (*Azadirachta Indica*) | 10 to 18 ml v/v |
| Banyan Leaf Oil (*Ficus benghalensis*) | 3 to 10 ml v/v |
| Ashoka Leaf Oil (*Saraca asoca*) | 2 to 12 ml v/v |
| Linseed Oil (*Linum usitatissimum*) | 8 to 16 ml v/v |
| Clove Oil (*Eugenia cayophyllata*) | 5 to 8 ml v/v |
| Lemongrass Oil (*Cymbopogan flexuosus*) | 12 to 20 ml v/v |
| Indian Bay Leaf Oil (*Cinnamomum tamala*) | 2 to 4.5 ml v/v |
| Jojoba Oil (*Simmondsia chenesis*) | 30 to 50 ml v/v |
| Teak Oil (*Tectona grandis*) | 45 to 70 ml v/v |
| Turmeric Oil (*Curcuma longa*) | 1.5 to 4.5 ml v/v |
| Cedarwood Oil (*Cedrus atlantica*) | 5 to 9 ml v/v |
| Turpentine Oil (*Pinus roxburghii*) | 55 to 95 ml v/v |
| Coconut Oil (*Cocus nucifera*) | 75 to 90 ml v/v |
| Sunflower Oil (*Helianthus annus*) | 20 to 75 ml v/v |
| Peepal Leaf oil (*Ficus religiosa*) | 25 to 40 ml v/v |
| Basil Leaf Oil (*Ocimum basilicum*) | 3 to 7.5 ml v/v |
| White Cedar Leaf Oil (*Thuja occidentalis*) | 12 to 25 ml v/v |
| Lemon *Eucalyptus* Oil (*Corymbia citriodora*) | 1.5 to 3.5 ml v/v |
| Sheesham Oil (*Dalbergia sissoo*) | 18 to 24 ml v/v |
| Olive Oil (*Olea europaea*) | 40 to 60 ml v/v |
| Key Lime Oil (*Citrus aurantifolia*) | 4 to 9 ml v/v |
| Khella Oil (*Ammi visagna*) | 20 to 30 ml v/v |
| Indian Bael Leaf Oil (*Aegle marmelos*) | 25 to 28 ml v/v |

to make 1000 ml of the Fuel Supplement composition, by gentle stirring and maintaining the temperature between 16 to 24° C. The mixture is then filtered to remove any impurities or particulate matter. The composition is warmed in a closed metallic container in water at temperature of 40 to 60° C., for 60 to 90 minutes after which it is cooled without stirring to temperature of 16 to 24° C. for 45 to 60 minutes. The final step is filtering the Fuel Supplement composition and packing in aluminium or amber coloured glass bottles.

Diesel Supplement:

Example 1

Crystalline Thymol (extracted from *Thymus vulgaris*) in the range of 10 to 16 mg, Crystalline Mint (extracted from *Mentha arvensis*) in the range of 60 to 95 mg and Crystalline Camphor (*Cinnamomum Camphora*) in the range of 69 to 94 mg is mixed in 100 ml of Diesel.

Then following oils in given order are slowly added to the above prepared mixture

| | |
|---|---|
| Cedarwood Oil (*Cedrus atlantica*) | 20 to 28 ml v/v |
| Banyan Leaf Oil (*Ficus benghalensis* | 4 to 10 ml v/v |
| Turpentine Oil (*Pinus roxburghii*) | 60 to 85 ml v/v |
| Groundnut Oil (*Arachis hypogaea*) | 10 to 14 ml v/v |
| Liquid Paraffin Oil | 6 to 14 ml v/v |
| Linseed Oil (*Linum usitatissimum*) | 2 to 6 ml v/v |
| Indian Bay Leaf Oil (*Cinnamomum tamala*) | 40 to 50 ml v/v |
| Clove Oil (*Eugenia cayophyllata*) | 12 to 18 ml v/v |
| Khella Oil (*Ammi visagna*) | 10 to 18 ml v/v |
| Indian Bael Leaf Oil (*Aegle marmelos*) | 18 to 28 ml v/v |
| Key Lime Oil (*Citrus aurantifolia*) | 5 to 8 ml v/v |
| Jojoba Oil (*Simmondsia chenesis*) | 0.1 to 1.0 ml v/v |
| Olive Oil (*Olea europaea*) | 15 to 21 ml v/v |
| Teak Oil (*Tectona grandis*) | 9 to 17 ml v/v |
| Sheesham Oil (*Dalbergia sissoo*) | 1 to 4 ml v/v |
| Sunflower Oil (*Helianthus annus*) | 45 to 67 ml v/v |
| *Eucalyptus* Oil (*Corymbia citriodora*) | 10 to 15 ml v/v |
| Lemongrass Oil (*Cymbopogan citratus*) | 8 to 17 ml v/v |

-continued

| | |
|---|---|
| Basil Leaf Oil (*Ocimum basilicum*) | 19 to 30 ml v/v |
| White Cedar Leaf Oil (*Thuja occidentalis*) | 36 to 50 ml v/v |
| Turmeric Oil (*Curcuma longa*) | 1 to 4 ml v/v |

to make 1000 ml of the Fuel Supplement composition, by gentle stirring and maintaining the temperature between 18 to 24° C. The mixture is then filtered to remove any impurities or particulate matter. The composition is warmed in a closed metallic container in water at temperature of 40 to 60° C., for 45 to 60 minutes after which it is cooled without stirring to temperature of 16 to 24° C. for 45 to 60 minutes. The final step is filtering the Fuel Supplement composition and packing in aluminium or amber coloured glass bottles.

Test results are given in Table 3

Example 2

Crystalline Thymol (extracted from *Thymus vulgaris*) in the range of 18 to 30 mg, Crystalline Mint (extracted from *Mentha arvensis*) in the range of 75 to 125 mg and Crystalline Camphor (*Cinnamomum Camphora*) in the range of 80 to 109 mg is mixed in 100 ml of Diesel.

Then following oils in given order are slowly added to the above prepared mixture

| | |
|---|---|
| Cedarwood Oil (*Cedrus atlantica*) | 40 to 52 ml v/v |
| Banyan Leaf Oil (*Ficus benghalensis* | 8 to 18 ml v/v |
| Turpentine Oil (*Pinus roxburghii*) | 108 to 137 ml v/v |
| Groundnut Oil (*Arachis hypogaea*) | 11 to 20 ml v/v |
| Liquid Paraffin Oil | 10 to 25 ml v/v |
| Linseed Oil (*Linum usitatissimum*) | 3 to 10 ml v/v |
| Indian Bay Leaf Oil (*Cinnamomum tamala*) | 20 to 38 ml v/v |
| Clove Oil (*Eugenia cayophyllata*) | 20 to 29 ml v/v |
| Khella Oil (*Ammi visagna*) | 20 to 32 ml v/v |
| Indian Bael Leaf Oil (*Aegle marmelos*) | 40 to 56 ml v/v |
| Key Lime Oil (*Citrus aurantifolia*) | 10 to 17 ml v/v |
| Jojoba Oil (*Simmondsia chenesis*) | 2.5 to 4 ml v/v |
| Olive Oil (*Olea europaea*) | 19 to 27 ml v/v |
| Teak Oil (*Tectona grandis*) | 15 to 25 ml v/v |
| Sheesham Oil (*Dalbergia sissoo*) | 3 to 6 ml v/v |
| Sunflower Oil (*Helianthus annus*) | 28 to 40 ml v/v |
| *Eucalyptus* Oil (*Corymbia citriodora*) | 40 to 55 ml v/v |
| Lemongrass Oil (*Cymbopogan citratus*) | 15 to 30 ml v/v |
| Basil Leaf Oil (*Ocimum basilicum*) | 5 to 14 ml v/v |
| White Cedar Leaf Oil (*Thuja occidentalis*) | 10 to 19 ml v/v |
| Turmeric Oil (*Curcuma longa*) | 8 to 14 ml v/v |

to make 1000 ml of the Fuel Supplement composition, by gentle stirring and maintaining the temperature between 18 to 24° C. The mixture is then filtered to remove any impurities or particulate matter. The composition is warmed in a closed metallic container in water at temperature of 40 to 60° C., for 45 to 60 minutes after which it is cooled without stirring to temperature of 16 to 24° C. for 45 to 60 minutes. The final step is filtering the Fuel Supplement composition and packing in aluminium or amber coloured glass bottles.

Test results are given in Table 3

Example 3

Crystalline Thymol (extracted from *Thymus vulgaris*) in the range of 40 to 60 mg, Crystalline Mint (extracted from *Mentha arvensis*) in the range of 200 to 260 mg and Crystalline Camphor (*Cinnamomum Camphora*) in the range of 125 to 156 mg is mixed in 100 ml of Diesel.

Then following oils in given order are slowly added to the above prepared mixture

| | |
|---|---|
| Cedarwood Oil (*Cedrus atlantica*) | 18 to 26 ml v/v |
| Banyan Leaf Oil (*Ficus benghalensis* | 15 to 30 ml v/v |
| Turpentine Oil (*Pinus roxburghii*) | 35 to 52 ml v/v |
| Groundnut Oil (*Arachis hypogaea*) | 16 to 22 ml v/v |
| Liquid Paraffin Oil | 17 to 30 ml v/v |
| Linseed Oil (*Linum usitatissimum*) | 7 to 16 ml v/v |
| Indian Bay Leaf Oil (*Cinnamomum tamala*) | 60 to 75 ml v/v |
| Clove Oil (*Eugenia cayophyllata*) | 25 to 35 ml v/v |
| Khella Oil (*Ammi visagna*) | 50 to 72 ml v/v |
| Indian Bael Leaf Oil (*Aegle marmelos*) | 9 to 20 ml v/v |
| Key Lime Oil (*Citrus aurantifolia*) | 2 to 6 ml v/v |
| Jojoba Oil (*Simmondsia chenesis*) | 5 to 6.5 ml v/v |
| Olive Oil (*Olea europaea*) | 40 to 56 ml v/v |
| Teak Oil (*Tectona grandis*) | 29 to 42 ml v/v |
| Sheesham Oil (*Dalbergia sissoo*) | 7 to 10 ml v/v |
| Sunflower Oil (*Helianthus annus*) | 9 to 21 ml v/v |
| *Eucalyptus* Oil (*Corymbia citriodora*) | 35 to 50 ml v/v |
| Lemongrass Oil (*Cymbopogan citratus*) | 20 to 38 ml v/v |
| Basil Leaf Oil (*Ocimum basilicum*) | 50 to 62 ml v/v |
| White Cedar Leaf Oil (*Thuja occidentalis*) | 24 to 32 ml v/v |
| Turmeric Oil (*Curcuma longa*) | 20 to 28 ml v/v |

to make 1000 ml of the Fuel Supplement composition, by gentle stirring and maintaining the temperature between 18 to 24° C. The mixture is then filtered to remove any impurities or particulate matter. The composition is warmed in a closed metallic container in water at temperature of 40 to 60° C., for 45 to 60 minutes after which it is cooled without stirring to temperature of 16 to 24° C. for 45 to 60 minutes. The final step is filtering the Fuel Supplement composition and packing in aluminium or amber coloured glass bottles.

Test results are given in Table 3

Tables of Comparison/Data of Tests

TABLE 1

Fuel Supplement - Petrol

| Test | Petrol | Example 1 | Example 2 | Example 3 |
|---|---|---|---|---|
| pH | 7.35 | 7.02 | 7.1 | 6.6 |
| Density @ 25° C. | 0.7395 g/ml | 0.7437 g/ml | 0.7435 g/ml | 0.7422 g/ml |
| Sulphur | 0.26% | 0.07% | 0.09% | 0.12% |
| GCV | 9314 cal/g | 9476 cal/g | 9457 cal/g | 9510 cal/g |

TABLE 2

Fuel Supplement v/s Indian Patent 267145

| Test | Petrol | Example 1 | Patent 267145 |
|---|---|---|---|
| pH | 7.35 | 7.02 | 6.6 |
| Density @ 25° C. | 0.7395 g/ml | 0.7437 g/ml | 0.7422 g/ml |
| Sulphur | 0.26% | 0.07% | 0.12% |
| GCV | 9314 cal/g | 9476 cal/g | 9510 cal/g |

TABLE 3

Fuel Supplement - Diesel

| Test | Diesel | Example 1 | Example 2 | Example 3 |
|---|---|---|---|---|
| Acidity | 0.06% | 0.05% | 0.07% | 0.06% |
| Kinematic Viscosity | 2.26 cst | 2.36 cst | 2.33 cst | 2.33 cst |

TABLE 3-continued

| Fuel Supplement - Diesel | | | | |
|---|---|---|---|---|
| Test | Diesel | Example 1 | Example 2 | Example 3 |
| Density @ 25° C. | 0.8151 g/ml | 0.8192 g/ml | 0.8195 g/ml | 0.8194 g/ml |
| Sulphur | 0.29% | 0.23% | 0.21% | 0.16% |
| Flash point | 55° C. | 57° C. | 65° C. | 60° C. |
| GCV | 10,394 cal/g | 10,099 cal/g | 10,198 cal/g | 10,149 cal/g |

TABLE 4

| Fuel Supplement - Diesel v/s Indian Patent 267145 | | | |
|---|---|---|---|
| Test | Diesel | Example 3 | Patent 267145 |
| Acidity | 0.06% | 0.06% | 0.28% |
| Kinematic Viscosity | 2.26 cst | 2.33 cst | 2.33 cst |
| Density @ 25° C. | 0.8151 g/ml | 0.8194 g/ml | 0.8191 g/ml |
| Sulphur | 0.29% | 0.16% | 0.20% |
| Flash point | 55° C. | 60° C. | 58° C. |
| GCV | 10,394 cal/g | 10,149 cal/g | 10,496 cal/g |

TABLE 5

| Petrol-Emission Data (PUC) | | | | | |
|---|---|---|---|---|---|
| | CO | CO2 | NOx | HC | O2 |
| Vehicle 1 - Petrol | 0.081% | 15.39% | 0 | 93 ppm | 22.0% |
| Vehicle 2 - Petrol | 0.89% | 16.2% | 0 | 19 ppm | 20.04% |
| Vehicle 1 - Petrol + Fuel Supplement | 0.230% | 14.58% | 0 | 46 ppm | 22.6% |
| Vehicle 2 - Petrol + Fuel Supplement | 0.57% | 2.0% | 0 | 0 ppm | 21.18% |

TABLE 6

| Diesel - Emission Data (PUC) | | |
|---|---|---|
| | LAC (Light Absorption co-efficient) (l/metre) | HSU (Hartridge Smoke Units) |
| Vehicle 1 - Diesel | 0.76 | 28.0 |
| Vehicle 2 - Diesel | 0.75 | 27.6 |
| Vehicle 1 + Fuel Supplement | 0.69 | 25.9 |
| Vehicle 2 + Fuel Supplement | 0.70 | 26.2 |

TABLE 7

| Hydrocarbon emissions of Petrol compared with Petrol + Fuel Supplement-Petrol Example 1 | | |
|---|---|---|
| Name | Petrol | Petrol + FSPetrol 1 |
| Butane | 33109879 | 27675977 |
| Butane, 2-methyl- | 58488520 | 37075202 |
| Propanoyl chloride, 2-methyl- | 76992236 | 0 |
| Oxalic acid, dineopentyl ester | 62266237 | 0 |
| Butane, 2,3-dimethyl- | 45037872 | 0 |
| Cyclopentane, methyl- | 38509800 | 35261551 |
| cyclopenatene, 1-methyl- | 15481963 | 15891455 |
| 3-hexanone | 38088124 | 44812296 |
| cyclohexane, methyl | 31515663 | 0 |

TABLE 7-continued

| Hydrocarbon emissions of Petrol compared with Petrol + Fuel Supplement-Petrol Example 1 | | |
|---|---|---|
| Name | Petrol | Petrol + FSPetrol 1 |
| Hexane, 2,3,3-trimethyl- | 12617984 | 12482860 |
| cyclohexane, 1,3-dimethyl-, cis- | 21964812 | 24796352 |
| Cyclopentane, 1-ethyl-3-methyl- | 45817716 | 45688152 |
| Cyclopentane, 1-ethyl-2 methyl-, cis- | 51610262 | 0 |
| Heptane, 2,4-dimethyl- | 135898355 | 83715304 |
| 1,3-dimethyl-1-cyclohexane | 33620546 | 34013229 |
| 4-undecena, (Z)- | 7731233 | 0 |
| 1-hetpanol, 3-methyl- | 11994059 | 9311940 |
| Dodecane | 6970164 | 8646745 |
| Cyclopentane, 1-methyl-2-propyl- | 10620597 | 11114859 |
| 1-ethyl-4-methylcyclohexane | 18126754 | 15240071 |
| Cyclohexanementhanol, 4-(1-methylethyl)-, cis- | 10004620 | 9815960 |
| Undecane, 4,4-dimethyl- | 5427633 | 0 |
| Cyclopentane, 1,3-dimethyl-2-(1-methyletheny) | 7492341 | 0 |
| Benzene, 1-ethyl-3-methyl- | 31433531 | 0 |
| Cyclohexane, eicosyl- | 14528008 | 13386471 |
| Nonane, 3-methyl- | 14094235 | 13774464 |
| Benzene, propyl- | 70438173 | 0 |
| Benzene, 1-ethyl-2-methyl- | 152808763 | 29680487 |
| mesitylene | 64060724 | 61379814 |
| 5-decene | 4540393 | 0 |
| Benzene, (1-nethylpropyl)- | 4803953 | 0 |
| Indane | 36755216 | 29118918 |
| 5-Cholorovaleric acid, 3-pentadecyl ester | 7191437 | 0 |
| 1H-Indene, 1-chloro-2,3-dihyro- | 4212490 | 0 |
| Benzene, 1-methyl-3-(1-methylethyl)- | 20609939 | 20095260 |
| Benzene, 1-methyl-3-propyl- | 25940252 | 27454972 |
| Benzene, butyl- | 27141354 | 0 |
| Nonane, 2,5-dimethyl- | 23854904 | 23262238 |
| Sprio(3.5)nona-5,7-dien-1-one, 5,9,9-trimethyl | 28800446 | 0 |
| Suplurous acid, 2-ethylhexyl hexyl ester | 17699257 | 0 |
| Benzene, 1-methyl-2-propyl- | 14095943 | 13611057 |
| Undecane, 3,4-dimethyl- | 13514880 | 0 |
| Benzene, 2-ethyl-1,4-dimethyl- | 35143509 | 0 |
| Benzene, 1-ethyl-2,4-dimethyl- | 16209498 | 48909916 |
| 1-phenyl-1-butene | 4162335 | 0 |
| Benzene, 1-ethyl-3,5-dimethyl- | 44841664 | 0 |
| Undecane | 28106271 | 25945481 |
| Benzene, 1,2,3,5-tetramethyl- | 27618439 | 25067590 |
| Benzene, 1-methyl-2-(2-propenyl)- | 17829684 | 16520384 |
| Benzene, 1,4-dimethyl-2-methyl- | 10247040 | 0 |
| 1H-Indene, 2,3-dihydro-5-methyl- | 13047729 | 13776194 |
| Benzene, 1,2,3,5-tetramethyl- | 12432102 | 25339329 |
| Naphthalene | 12248309 | 13437548 |
| Propanoic acid, 2-methyl-, propyl ester | 0 | 15061006 |
| Butane, 2,3-dimethyl- | 0 | 49788485 |
| Cyclopentane, 1,2,3-trimethyl-, (1.alpha, 2.alpha) | 0 | 19323997 |
| 3-methyl-3-hexene | 0 | 10394761 |
| cyclohexane, methyl- | 0 | 31505483 |
| 2,4,4,6,6,8,8-heptamethyl-2-nonene- | 0 | 48990589 |
| 4,4-dimethyl octane | 0 | 9983759 |
| 1H-Indene, octahydro-, cis- | 0 | 12137158 |
| Benzene, 1-ethyl, 2-methyl | 0 | 139104149 |
| Octane, 3,5-dimethyl- | 0 | 28670264 |
| Benzene, 1,3-diethyl- | 0 | 26877537 |
| Spiro(3.5)nona-5,7-dien-1-one, 5,9,9-trimethy | 0 | 28564898 |
| Sulfurous acid, 2-ethylhexyl hexyl ester | 0 | 17105766 |
| Nonane, 3,7-dimethyl- | 0 | 14317601 |
| Benzene, 1-ethyl-3,5-dimethyl- | 0 | 41161810 |
| P-cymene | 0 | 19590187 |
| (+)-2-Bornanone | 0 | 101496278 |
| Isoborneol | 0 | 97805189 |
| Bicyclo(2.2.1)heptan-2-ol, 1,7,7-trimethyl- | 0 | 11582731 |
| Cyclohexanol, 5-methyl-2-(1-methylethyl)- | 0 | 102255241 |
| 2-Isopropenyl-5-methylhex-4-enal | 0 | 12798807 |
| 2,6-Octadienal, 3,7-dimethyl-, (E)- | 0 | 15713770 |
| 3-Methyl-4-isopropylphenol | 0 | 8713864 |

TABLE 8

Hydrocarbon emissions of Petrol compared with Petrol + Fuel Supplement-Petrol Example 2

| Name | Petrol | Petrol + FSPetrol 2 |
|---|---|---|
| Butane | 33109879 | 0 |
| Butane, 2-methyl- | 58488520 | 0 |
| Propanoyl chloride, 2-methyl- | 76992236 | 0 |
| Oxalic acid, dineopentyl ester | 62266237 | 0 |
| Butane, 2,3-dimethyl- | 45037872 | 0 |
| Cyclopentane, methyl- | 38509800 | 360119 |
| cyclopenatene, 1-methyl- | 15481963 | 0 |
| 3-hexanone | 38088124 | 0 |
| cyclohexane, methyl | 31515663 | 0 |
| Hexane, 2,3,3-trimethyl- | 12617984 | 0 |
| cyclohexane, 1,3-dimethyl-, cis- | 21964812 | 0 |
| Cyclopentane, 1-ethyl-3-methyl- | 45817716 | 0 |
| Cyclopentane, 1-ethyl-2 methyl-, cis- | 51610262 | 0 |
| Heptane, 2,4-dimethyl- | 135898355 | 0 |
| 1,3-dimethyl-1-cyclohexane | 33620546 | 0 |
| 4-undecena, (Z)- | 7731233 | 0 |
| 1-hetpanol, 3-methyl- | 11994059 | 0 |
| Dodecane | 6970164 | 0 |
| Cyclopentane, 1-methyl-2-propyl- | 10620597 | 0 |
| 1-ethyl-4-methylcyclohexane | 18126754 | 0 |
| Cyclohexanementhanol, 4-(1-methylethyl)-, cis- | 10004620 | 0 |
| Undecane, 4,4-dimethyl- | 5427633 | 0 |
| Cyclopentane, 1,3-dimethyl-2-(1-methyletheny) | 7492341 | 0 |
| Benzene, 1-ethyl-3-methyl- | 31433531 | 682702 |
| Cyclohexane, eicosyl- | 14528008 | 0 |
| Nonane, 3-methyl- | 14094235 | 0 |
| Benzene, propyl- | 70438173 | 0 |
| Benzene, 1-ethyl-2-methyl- | 152808763 | 0 |
| mesitylene | 64060724 | 0 |
| 5-decene | 4540393 | 0 |
| Benzene, (1-nethylpropyl)- | 4803953 | 0 |
| Indane | 36755216 | 0 |
| 5-Cholorovaleric acid, 3-pentadecyl ester | 7191437 | 0 |
| 1H-Indene, 1-chloro-2,3-dihyro- | 4212490 | 0 |
| Benzene, 1-methyl-3-(1-methylethyl)- | 20609939 | 0 |
| Benzene, 1-methyl-3-propyl- | 25940252 | 0 |
| Benzene, butyl- | 27141354 | 0 |
| Nonane, 2,5-dimethyl- | 23854904 | 0 |
| Sprio(3.5)nona-5,7-dien-1-one, 5,9,9-trimethyl | 28800446 | 0 |
| Suplurous acid, 2-ethylhexyl hexyl ester | 17699257 | 0 |
| Benzene, 1-methyl-2-propyl- | 14095943 | 0 |
| Undecane, 3,4-dimethyl- | 13514880 | 0 |
| Benzene, 2-ethyl-1,4-dimethyl- | 35143509 | 0 |
| Benzene, 1-ethyl-2,4-dimethyl- | 16209498 | 0 |
| 1-phenyl-1-butene | 4162335 | 0 |
| Benzene, 1-ethyl-3,5-dimethyl- | 44841664 | 0 |
| Undecane | 28106271 | 0 |
| Benzene, 1,2,3,5-tetramethyl- | 27618439 | 0 |
| Benzene, 1-methyl-2-(2-propenyl)- | 17829684 | 0 |
| Benzene, 1,4-dimethyl-2-methyl- | 10247040 | 0 |
| 1H-Indene, 2,3-dihydro-5-methyl- | 13047729 | 0 |
| Benzene, 1,2,3,5-tetramethyl- | 12432102 | 0 |
| Naphthalene | 12248309 | 0 |
| cyclohexane, methyl- | 0 | 738859 |
| Cyclohexanol, 5-methyl-2-(1-methylethyl)- | 0 | 136061 |
| Propanenitrile | 0 | 3014920 |
| Butaonic acid, 4-hexen-1-yl ester | 0 | 226186 |
| Hexane, 2-chloro- | 0 | 2103624 |
| Hexane, 3-methyl- | 0 | 1089015 |
| Tridecane, 3-methylene- | 0 | 526935 |
| Heptane | 0 | 720841 |
| 3-Hexene, 3-methyl-(E)- | 0 | 224897 |
| Heptane, 2-methyl- | 0 | 446017 |
| Toluene | 0 | 7368472 |
| Octane | 0 | 423618 |
| Formic acid, 2-ethylhexyl ester | 0 | 101115 |
| Octane, 2-methyl- | 0 | 591209 |
| Ethylbenzene | 0 | 872994 |
| Benzene, 1,3-dimethyl- | 0 | 3504046 |
| Mesitylene | 0 | 187701 |
| Benzene, 1-ethyl-3 methyl- | 0 | 122525 |

TABLE 8-continued

Hydrocarbon emissions of Petrol compared with Petrol + Fuel Supplement-Petrol Example 2

| Name | Petrol | Petrol + FSPetrol 2 |
|---|---|---|
| Benzene, 1,2,3-trimethyl- | 0 | 187061 |
| Bicyclo [2.2.1]heptan-2-one, 1,7,7-trimethyl- | 0 | 289768 |
| Isoborneol | 0 | 168459 |

TABLE 9

Hydrocarbon emissions of Petrol compared with Petrol + Fuel Supplement - Indian Patent 267145

| Name | Petrol | Petrol + Patent 267145 |
|---|---|---|
| Butane | 33109879 | 0 |
| Butane, 2-methyl- | 58488520 | 0 |
| Propanoyl chloride, 2-methyl- | 76992236 | 0 |
| Oxalic acid, dineopentyl ester | 62266237 | 0 |
| Butane, 2,3-dimethyl- | 45037872 | 0 |
| Cyclopentane, methyl- | 38509800 | 0 |
| cyclopenatene, 1-methyl- | 15481963 | 0 |
| 3-hexanone | 38088124 | 0 |
| cyclohexane, methyl | 31515663 | 0 |
| Hexane, 2,3,3-trimethyl- | 12617984 | 0 |
| cyclohexane, 1,3-dimethyl-, cis- | 21964812 | 0 |
| Cyclopentane, 1-ethyl-3-methyl- | 45817716 | 0 |
| Cyclopentane, 1-ethyl-2 methyl-, cis- | 51610262 | 0 |
| Heptane, 2,4-dimethyl- | 135898355 | 0 |
| 1,3-dimethyl-1-cyclohexane | 33620546 | 0 |
| 4-undecena, (Z)- | 7731233 | 0 |
| 1-hetpanol, 3-methyl- | 11994059 | 0 |
| Dodecane | 6970164 | 0 |
| Cyclopentane, 1-methyl-2-propyl- | 10620597 | 0 |
| 1-ethyl-4-methylcyclohexane | 18126754 | 0 |
| Cyclohexanementhanol, 4-(1-methylethyl)-, cis- | 10004620 | 0 |
| Undecane, 4,4-dimethyl- | 5427633 | 0 |
| Cyclopentane, 1,3-dimethyl-2-(1-methyletheny) | 7492341 | 0 |
| Benzene, 1-ethyl-3-methyl- | 31433531 | 1200085 |
| Cyclohexane, eicosyl- | 14528008 | 0 |
| Nonane, 3-methyl- | 14094235 | 290887 |
| Benzene, propyl- | 70438173 | 450969 |
| Benzene, 1-ethyl-2-methyl- | 152808763 | 4133833 |
| mesitylene | 64060724 | 835211 |
| 5-decene | 4540393 | 0 |
| Benzene, (1-nethylpropyl)- | 4803953 | 0 |
| Indane | 36755216 | 233617 |
| 5-Cholorovaleric acid, 3-pentadecyl ester | 7191437 | 0 |
| 1H-Indene, 1-chloro-2,3-dihyro- | 4212490 | 0 |
| Benzene, 1-methyl-3-(1-methylethyl)- | 20609939 | 0 |
| Benzene, 1-methyl-3-propyl- | 25940252 | 325595 |
| Benzene, butyl- | 27141354 | 0 |
| Nonane, 2,5-dimethyl- | 23854904 | 0 |
| Sprio(3.5)nona-5,7-dien-1-one, 5,9,9-trimethyl | 28800446 | 0 |
| Suplurous acid, 2-ethylhexyl hexyl ester | 17699257 | 0 |
| Benzene, 1-methyl-2-propyl- | 14095943 | 0 |
| Undecane, 3,4-dimethyl- | 13514880 | 0 |
| Benzene, 2-ethyl-1,4-dimethyl- | 35143509 | 320380 |
| Benzene, 1-ethyl-2,4-dimethyl- | 16209498 | 0 |
| 1-phenyl-1-butene | 4162335 | 0 |
| Benzene, 1-ethyl-3,5-dimethyl- | 44841664 | 0 |
| Undecane | 28106271 | 204173 |
| Benzene, 1,2,3,5-tetramethyl- | 27618439 | 0 |
| Benzene, 1-methyl-2-(2-propenyl)- | 17829684 | 0 |
| Benzene, 1,4-dimethyl-2-methyl- | 10247040 | 0 |
| 1H-Indene, 2,3-dihydro-5-methyl- | 13047729 | 0 |
| Benzene, 1,2,3,5-tetramethyl- | 12432102 | 0 |
| Naphthalene | 12248309 | 0 |
| 3-methyl-3-hexene | 0 | 2148941 |
| cyclohexane, methyl- | 0 | 4532324 |
| Isoborneol | 0 | 578161 |

TABLE 9-continued

Hydrocarbon emissions of Petrol compared with Petrol + Fuel Supplement - Indian Patent 267145

| Name | Petrol | Petrol + Patent 267145 |
|---|---|---|
| Cyclohexanol, 5-methyl-2-(1-methylethyl)- | 0 | 680240 |
| Hexane, 2-chloro- | 0 | 12829604 |
| Hexane, 3-methyl- | 0 | 7337531 |
| Heptane, 2-methyl- | 0 | 2473230 |
| Ethylbenzene | 0 | 9087598 |
| Cyclopropane | 0 | 21344820 |
| Cyclopenatne, methyl- | 0 | 3340117 |
| Propanenitrile | 0 | 3844626 |
| Butanoic acid, 4-hexen-1-yl ester | 0 | 1618780 |
| 1-Heptene, 5-methyl- | 0 | 4712104 |
| 4-Methyl-2-hexene, c&t | 0 | 339247 |
| 1,3-Pentadiene, 2,3-dimethyl- | 0 | 517918 |
| Cylcopentane, ethyl- | 0 | 433976 |
| 1-Decen-3-one | 0 | 299091 |
| Cyclopentane, 1,2,3-trimethyl-, (1.alpha, 2.alpha) | 0 | 189433 |
| 4-t-Pentylcylcohexene | 0 | 1015126 |
| Toluene | 0 | 30878981 |
| Cylcohexane, 1,2-dimethyl-, cis- | 0 | 501018 |
| Cylcopentane, 1-ethyl-3-methyl- | 0 | 704545 |
| Hexane, 2,4-dimethyl- | 0 | 2810126 |
| Cylcohexane, 1,4-dimethyl- | 0 | 616253 |
| Cyclopentene, 1,2,3-trimethyl- | 0 | 503907 |
| Decane, 2,9-dimethyl- | 0 | 209152 |
| Formic acid, 2-ethylhexyl ester | 0 | 651277 |
| p-Xylene | 0 | 20928573 |
| o-Xylene | 0 | 521412 |
| Benzene, (1-methylethyl)- | 0 | 135564 |
| Cyclohexane, 1,3-butadienylidene- | 0 | 268613 |
| Benzene, (1,3,3-trimethylnonyl)- | 0 | 151481 |
| Benzene-2-ethyl-1,4-dimethyl- | 0 | 204471 |
| Bnezene, 1-methyl-3-(1-methylethyl)- | 0 | 146216 |
| Benzene, 1,2,4,5-tetramethyl- | 0 | 163299 |
| Benzene, 1,2,3,4-tetramethyl- | 0 | 234725 |

TABLE 10

Hydrocarbon emissions of Diesel with Diesel + Fuel Supplement - Diesel Example 1

| Name | Diesel | Diesel + FSDiesel1 |
|---|---|---|
| 1-Ethyl-4-methylcyclohexane | 9098065 | 0 |
| 1-Octadecanesulphonyl chloride | 37086941 | 0 |
| 1-Pentanol, 4-methyl-2-propyl- | 32117059 | 0 |
| 2-methyloctacosane | 12892448 | 0 |
| 3-Chlorohexane | 14381809 | 0 |
| 6-Octen-1-yn-3-ol, 3,7-dimethyl- | 31349535 | 0 |
| 7-Methylbicyclo[4.2.0]octane | 20185030 | 0 |
| Benzene, 1-ethyl-3-methyl- | 40170157 | 0 |
| Benzene, propyl- | 14887227 | 11126419 |
| Cyclohexane, 1,3-dimethyl-, cis- | 17385703 | 0 |
| Cyclohexane, ethyl- | 41368679 | 32601862 |
| Cyclohexane, methyl- | 25212595 | 16401438 |
| Decane | 69430089 | 63549797 |
| Dodecane | 47627242 | 184997783 |
| Dodecane, 4-cyclohexyl- | 9014486 | 0 |
| Eicosane | 407488647 | 699776121 |
| Heneicosane | 71336049 | 0 |
| Heptadecane | 113379319 | 0 |
| Heptane | 12181976 | 10511230 |
| Heptane, 2,6-dimethyl- | 15427262 | 13704173 |
| Heptane, 5-ethyl-2-methyl- | 26352863 | 0 |
| Hexadecane, 2,6,10,14-tetramethyl- | 21684641 | 47277422 |
| Hexane, 2,4-dimethyl- | 47194205 | 0 |
| ide, 2--tert-butoxycarbonylamino-N2-benzylox | 28500960 | 0 |
| Megastigma-3,7(E),9-triene | 25241090 | 0 |
| Nonane | 73171239 | 64616828 |

TABLE 10-continued

Hydrocarbon emissions of Diesel with Diesel + Fuel Supplement - Diesel Example 1

| Name | Diesel | Diesel + FSDiesel1 |
|---|---|---|
| Nonane, 3-methyl- | 31590551 | 0 |
| Nonane, 5-(2-methylpropyl)- | 9825542 | 0 |
| Octadecane, 3-methyl- | 24840441 | 0 |
| Octane, 4,5-dipropyl- | 11957087 | 0 |
| Pentadecane | 104785178 | 120705208 |
| Pentadecane, 2,6,10-trimethyl- | 64820281 | 38860716 |
| p-Xylene | 45188806 | 0 |
| Tetracosane | 159989043 | 123648601 |
| Tetradecane | 192197828 | 112837075 |
| Tetratetracontane | 38331283 | 37751402 |
| Toluene | 41430686 | 31601172 |
| trans-1,2-Diethyl cyclopentane | 17135350 | 0 |
| Tricosane | 48460036 | 53075492 |
| Tridecane, 7-hexyl- | 76975880 | 62588080 |
| Undecane | 51495807 | 59498782 |
| 1,1-Difluoro-2,2-dimethyl-cyclopropane | 0 | 25233438 |
| 1,4-Cyclohexadiene, 3-ethenyl-1,2-dimethyl- | 0 | 16334103 |
| 1-Decene, 2,4-dimethyl- | 0 | 32665461 |
| 1H-Indene, 1-ethyl-2,3-dihydro-1-methyl- | 0 | 35578948 |
| 2-Tridecen-1-ol, (E)- | 0 | 13654610 |
| Benzene, (1,2,2-trimethylpropyl)- | 0 | 17713584 |
| Benzene, (1,3,3-trimethylnonyl)- | 0 | 47443308 |
| Benzene, 1,2-diethyl- | 0 | 23849305 |
| Benzene, 1,3-dimethyl- | 0 | 47101840 |
| bonyl)-1,4-dihydropyridin-4-ylidene]-2,2-dime | 0 | 18377172 |
| Camphor | 0 | 47086868 |
| Cyclohexane, 1,4-dimethyl- | 0 | 13946715 |
| d-Menthol | 0 | 17930634 |
| Heptadecane, 7-methyl- | 0 | 13290497 |
| Heptadecane, 9-hexyl- | 0 | 19528064 |
| Heptane, 4-(1-methylethyl)- | 0 | 12180196 |
| Hexadecane, 2-methyl- | 0 | 20574236 |
| Hexane, 2-chloro- | 0 | 10846990 |
| Hexanoic acid, pentadecyl ester | 0 | 14649545 |
| Isoborneol | 0 | 30926807 |
| Naphthalene, 1,2,3,4-tetrahydro-2,7-dimethyl- | 0 | 23530357 |
| Nonane, 4-ethyl-5-methyl- | 0 | 12811445 |
| Octane | 0 | 37278599 |
| Tetradecane, 4-methyl- | 0 | 80870913 |
| trans-1,3-Diethylcyclopentane | 0 | 15418790 |
| trans-p-mentha-1(7),8-dien-2-ol | 0 | 41425393 |
| Undecane, 2,5-dimethyl- | 0 | 12739396 |

TABLE 11

Hydrocarbon emissions of Diesel compared with Diesel + Fuel Supplement - Diesel Example 2

| Name | Diesel | Diesel + FSDiesel2 |
|---|---|---|
| 1-Ethyl-4-methylcyclohexane | 9098065 | 0 |
| 1-Octadecanesulphonyl chloride | 37086941 | 0 |
| 1-Pentanol, 4-methyl-2-propyl- | 32117059 | 24065526 |
| 2-methyloctacosane | 12892448 | 0 |
| 3-Chlorohexane | 14381809 | 0 |
| 6-Octen-1-yn-3-ol, 3,7-dimethyl- | 31349535 | 0 |
| 7-Methylbicyclo[4.2.0]octane | 20185030 | 14993294 |
| Benzene, 1-ethyl-3-methyl- | 40170157 | 0 |
| Benzene, propyl- | 14887227 | 0 |
| Cyclohexane, 1,3-dimethyl-, cis- | 17385703 | 0 |
| Cyclohexane, ethyl- | 41368679 | 31325668 |
| Cyclohexane, methyl- | 25212595 | 15344053 |
| Decane | 69430089 | 66172999 |
| Dodecane | 47627242 | 173322000 |
| Dodecane, 4-cyclohexyl- | 9014486 | 0 |
| Eicosane | 407488647 | 695318579 |
| Heneicosane | 71336049 | 0 |

TABLE 11-continued

Hydrocarbon emissions of Diesel compared with Diesel + Fuel Supplement - Diesel Example 2

| Name | Diesel | Diesel + FSDiesel2 |
|---|---|---|
| Heptadecane | 113379319 | 0 |
| Heptane | 12181976 | 0 |
| Heptane, 2,6-dimethyl- | 15427262 | 0 |
| Heptane, 5-ethyl-2-methyl- | 26352863 | 0 |
| Hexadecane, 2,6,10,14-tetramethyl- | 21684641 | 0 |
| Hexane, 2,4-dimethyl- | 47194205 | 0 |
| ide, 2--tert-butoxycarbonylamino-N2-benzylox | 28500960 | 0 |
| Megastigma-3,7(E),9-triene | 25241090 | 0 |
| Nonane | 73171239 | 63129983 |
| Nonane, 3-methyl- | 31590551 | 0 |
| Nonane, 5-(2-methylpropyl)- | 9825542 | 0 |
| Octadecane, 3-methyl- | 24840441 | 0 |
| Octane, 4,5-dipropyl- | 11957087 | 0 |
| Pentadecane | 104785178 | 113106006 |
| Pentadecane, 2,6,10-trimethyl- | 64820281 | 42458004 |
| p-Xylene | 45188806 | 0 |
| Tetracosane | 159989043 | 116471350 |
| Tetradecane | 192197828 | 111474687 |
| Tetratetracontane | 38331283 | 44318213 |
| Toluene | 41430686 | 30516027 |
| trans-1,2-Diethyl cyclopentane | 17135350 | 14400015 |
| Tricosane | 48460036 | 54358454 |
| Tridecane, 7-hexyl- | 76975880 | 0 |
| Undecane | 51495807 | 54177533 |
| 1H-Indene, 1-ethyl-2,3-dihydro-1-methyl- | 0 | 71079180 |
| Benzene, (1,3,3-trimethylnonyl)- | 0 | 31429458 |
| Benzene, 1,2-diethyl- | 0 | 22962942 |
| Benzene, 1,3-dimethyl- | 0 | 47949202 |
| bonyl)-1,4-dihydropyridin-4-ylidene]-2,2-dime | 0 | 18734072 |
| Carveol | 0 | 35185370 |
| cyclo[2.2.1]heptan-2-one, 1,7,7-trimethyl-, (1S | 0 | 50949555 |
| Cyclohexane, 1,4-dimethyl- | 0 | 13400918 |
| Cyclohexanol, 1-methyl-4-(1-methylethyl)- | 0 | 21183847 |
| Heptadecane, 9-hexyl- | 0 | 22587475 |
| Heptane, 2,6-dimethyl- | 0 | 12918278 |
| Hexadecane, 2,6,10,14-tetramethyl- | 0 | 43907321 |
| Hexadecane, 2-methyl- | 0 | 19102890 |
| Hexadecane, 7-methyl- | 0 | 15663858 |
| Hexanoic acid, octadecyl ester | 0 | 13506778 |
| Isoborneol | 0 | 43785067 |
| Naphthalene, 1,2,3,4-tetrahydro-2,7-dimethyl- | 0 | 49699512 |
| Nonadecane, 2-methyl- | 0 | 10913240 |
| Nonane, 4-ethyl-5-methyl- | 0 | 11830004 |
| Octadecane, 3-ethyl-5-(2-ethylbutyl)- | 0 | 39046053 |
| Octane | 0 | 36386004 |
| Octane, 1-chloro- | 0 | 24237864 |
| Tetradecane, 4-methyl- | 0 | 73279606 |
| Undecane, 2,5-dimethyl- | 0 | 12115327 |

TABLE 12

Hydrocarbon emissions of Diesel compared with Diesel + Fuel Supplement - Diesel Example 3

| Name | Diesel | Diesel + FSDiesel3 |
|---|---|---|
| 1-Ethyl-4-methylcyclohexane | 9098065 | 0 |
| 1-Octadecanesulphonyl chloride | 37086941 | 0 |
| 1-Pentanol, 4-methyl-2-propyl- | 32117059 | 23824715 |
| 2-methyloctacosane | 12892448 | 0 |
| 3-Chlorohexane | 14381809 | 0 |
| 6-Octen-1-yn-3-ol, 3,7-dimethyl- | 31349535 | 0 |
| 7-Methylbicyclo[4.2.0]octane | 20185030 | 15077665 |
| Benzene, 1-ethyl-3-methyl- | 40170157 | 30201025 |
| Benzene, propyl- | 14887227 | 0 |
| Cyclohexane, 1,3-dimethyl-, cis- | 17385703 | 0 |

TABLE 12-continued

Hydrocarbon emissions of Diesel compared with Diesel + Fuel Supplement - Diesel Example 3

| Name | Diesel | Diesel + FSDiesel3 |
|---|---|---|
| Cyclohexane, ethyl- | 41368679 | 30445569 |
| Cyclohexane, methyl- | 25212595 | 14940219 |
| Decane | 69430089 | 64860436 |
| Dodecane | 47627242 | 156998714 |
| Dodecane, 4-cyclohexyl- | 9014486 | 0 |
| Eicosane | 407488647 | 658798594 |
| Heneicosane | 71336049 | 13341068 |
| Heptadecane | 113379319 | 14713076 |
| Heptane | 12181976 | 0 |
| Heptane, 2,6-dimethyl- | 15427262 | 0 |
| Heptane, 5-ethyl-2-methyl- | 26352863 | 0 |
| Hexadecane, 2,6,10,14-tetramethyl- | 21684641 | 0 |
| Hexane, 2,4-dimethyl- | 47194205 | 0 |
| ide, 2--tert-butoxycarbonylamino-N2-benzylox | 28500960 | 0 |
| Megastigma-3,7(E),9-triene | 25241090 | 0 |
| Nonane | 73171239 | 62628894 |
| Nonane, 3-methyl- | 31590551 | 0 |
| Nonane, 5-(2-methylpropyl)- | 9825542 | 0 |
| Octadecane, 3-methyl- | 24840441 | 0 |
| Octane, 4,5-dipropyl- | 11957087 | 0 |
| Pentadecane | 104785178 | 130742556 |
| Pentadecane, 2,6,10-trimethyl- | 64820281 | 33607326 |
| p-Xylene | 45188806 | 0 |
| Tetracosane | 159989043 | 116796429 |
| Tetradecane | 192197828 | 111771567 |
| Tetratetracontane | 38331283 | 43680611 |
| Toluene | 41430686 | 29855324 |
| trans-1,2-Diethyl cyclopentane | 17135350 | 14157915 |
| Tricosane | 48460036 | 61370708 |
| Tridecane, 7-hexyl- | 76975880 | 0 |
| Undecane | 51495807 | 45354725 |
| 1,4-Cyclohexadiene, 3-ethenyl-1,2-dimethyl- | 0 | 11842310 |
| 1H-Indene, 1-ethyl-2,3-dihydro-1-methyl- | 0 | 32424814 |
| Benzene, 1,2-diethyl- | 0 | 23101448 |
| Benzene, 1,3-dimethyl- | 0 | 47856000 |
| bonyl)-1,4-dihydropyridin-4-ylidene]-2,2-dime | 0 | 18437477 |
| Carveol | 0 | 35819595 |
| cyclo[2.2.1]heptan-2-one, 1,7,7-trimethyl-, (1S | 0 | 60029268 |
| Cyclohexane, 1,4-dimethyl-, trans- | 0 | 12977786 |
| Eicosane, 9-cyclohexyl- | 0 | 25066776 |
| Heptane, 2,6-dimethyl- | 0 | 12817722 |
| Hexadecane, 2,6,10,14-tetramethyl- | 0 | 25824742 |
| Hexadecane, 2-methyl- | 0 | 17518421 |
| Hexadecane, 7,9-dimethyl- | 0 | 72472075 |
| Hexanoic acid, pentadecyl ester | 0 | 14373406 |
| Isoborneol | 0 | 39894198 |
| Levomenthol | 0 | 19759934 |
| Nonane, 4-ethyl-5-methyl- | 0 | 11700492 |
| Octane | 0 | 36448695 |
| Octane, 1-chloro- | 0 | 23856891 |
| Pentadecane, 3-methyl- | 0 | 15315160 |
| Trichloroacetic acid, hexadecyl ester | 0 | 24235898 |
| Tridecane, 7-hexyl- | 0 | 20260782 |

TABLE 13

Hydrocarbon emissions of Diesel compared with Diesel + Fuel Supplement - Diesel Examples 1, 2, 3

| Name | Diesel | Diesel + FSDiesel1 | Diesel + FSDiesel2 | Diesel + FSDiesel3 |
|---|---|---|---|---|
| 1-Ethyl-4-methylcyclohexane | 9098065 | 0 | 0 | 0 |
| 1-Octadecanesulphonyl chloride | 37086941 | 0 | 0 | 0 |
| 1-Pentanol, 4-methyl-2-propyl- | 32117059 | 0 | 24065526 | 23824715 |
| 2-methyloctacosane | 12892448 | 0 | 0 | 0 |
| 3-Chlorohexane | 14381809 | 0 | 0 | 0 |
| 6-Octen-1-yn-3-ol, 3,7-dimethyl- | 31349535 | 0 | 0 | 0 |
| 7-Methylbicyclo[4.2.0]octane | 20185030 | 0 | 14993294 | 15077665 |
| Benzene, 1-ethyl-3-methyl- | 40170157 | 0 | 0 | 30201025 |
| Benzene, propyl- | 14887227 | 11126419 | 0 | 0 |
| Cyclohexane, 1,3-dimethyl-, cis- | 17385703 | 0 | 0 | 0 |
| Cyclohexane, ethyl- | 41368679 | 32601862 | 31325668 | 30445569 |
| Cyclohexane, methyl- | 25212595 | 16401438 | 15344053 | 14940219 |
| Decane | 69430089 | 63549797 | 66172999 | 64860436 |
| Dodecane | 47627242 | 184997783 | 173322000 | 156998714 |
| Dodecane, 4-cyclohexyl- | 9014486 | 0 | 0 | 0 |
| Eicosane | 407488647 | 699776121 | 695318579 | 658798594 |
| Heneicosane | 71336049 | 0 | 0 | 13341068 |
| Heptadecane | 113379319 | 0 | 0 | 14713076 |
| Heptane | 12181976 | 10511230 | 0 | 0 |
| Heptane, 2,6-dimethyl- | 15427262 | 13704173 | 0 | 0 |
| Heptane, 5-ethyl-2-methyl- | 26352863 | 0 | 0 | 0 |
| Hexadecane, 2,6,10,14-tetramethyl- | 21684641 | 47277422 | 0 | 0 |
| Hexane, 2,4-dimethyl- | 47194205 | 0 | 0 | 0 |
| ide, 2--tert-butoxycarbonylamino-N2-benzylox | 28500960 | 0 | 0 | 0 |
| Megastigma-3,7(E),9-triene | 25241090 | 0 | 0 | 0 |
| Nonane | 73171239 | 64616828 | 63129983 | 62628894 |
| Nonane, 3-methyl- | 31590551 | 0 | 0 | 0 |
| Nonane, 5-(2-methylpropyl)- | 9825542 | 0 | 0 | 0 |
| Octadecane, 3-methyl- | 24840441 | 0 | 0 | 0 |
| Octane, 4,5-dipropyl- | 11957087 | 0 | 0 | 0 |
| Pentadecane | 104785178 | 120705208 | 113106006 | 130742556 |
| Pentadecane, 2,6,10-trimethyl- | 64820281 | 38860716 | 42458004 | 33607326 |
| p-Xylene | 45188806 | 0 | 0 | 0 |
| Tetracosane | 159989043 | 123648601 | 116471350 | 116796429 |
| Tetradecane | 192197828 | 112837075 | 111474687 | 111771567 |
| Tetratetracontane | 38331283 | 37751402 | 44318213 | 43680611 |
| Toluene | 41430686 | 31601172 | 30516027 | 29855324 |
| trans-1,2-Diethyl cyclopentane | 17135350 | 0 | 14400015 | 14157915 |
| Tricosane | 48460036 | 53075492 | 54358454 | 61370708 |
| Tridecane, 7-hexyl- | 76975880 | 62588080 | 0 | 0 |
| Undecane | 51495807 | 59498782 | 54177533 | 45354725 |
| 1,1-Difluoro-2,2-dimethyl-cyclopropane | 0 | 25233438 | 0 | 0 |
| 1,4-Cyclohexadiene, 3-ethenyl-1,2-dimethyl- | 0 | 16334103 | 0 | 11842310 |
| 1-Decene, 2,4-dimethyl- | 0 | 32665461 | 0 | 0 |
| 1H-Indene, 1-ethyl-2,3-dihydro-1-methyl- | 0 | 35578948 | 71079180 | 32424814 |
| 2-Tridecen-1-ol, (E)- | 0 | 13654610 | 0 | 0 |
| Benzene, (1,2,2-trimethylpropyl)- | 0 | 17713584 | 0 | 0 |
| Benzene, (1,3,3-trimethylnonyl)- | 0 | 47443308 | 31429458 | 0 |
| Benzene, 1,2-diethyl- | 0 | 23849305 | 22962942 | 23101448 |
| Benzene, 1,3-dimethyl- | 0 | 47101840 | | |
| bonyl)-1,4-dihydropyridin-4-ylidene]-2,2-dime | 0 | 18377172 | 18734072 | 18437477 |
| Camphor | 0 | 47086868 | 0 | 0 |
| Cyclohexane, 1,4-dimethyl- | 0 | 13946715 | 13400918 | 0 |
| d-Menthol | 0 | 17930634 | 0 | 0 |
| Heptadecane, 7-methyl- | 0 | 13290497 | 0 | 0 |
| Heptadecane, 9-hexyl- | 0 | 19528064 | 0 | 0 |
| Heptane, 4-(1-methylethyl)- | 0 | 12180196 | 0 | 0 |
| Hexadecane, 2-methyl- | 0 | 20574236 | 19102890 | 17518421 |
| Hexane, 2-chloro- | 0 | 10846990 | 0 | 0 |
| Hexanoic acid, pentadecyl ester | 0 | 14649545 | 0 | 14373406 |
| Isoborneol | 0 | 30926807 | 43785067 | 39894198 |
| Naphthalene, 1,2,3,4-tetrahydro-2,7-dimethyl- | 0 | 23530357 | 49699512 | 0 |
| Nonane, 4-ethyl-5-methyl- | 0 | 12811445 | 11830004 | 11700492 |
| Octane | 0 | 37278599 | 36386004 | 36448695 |

TABLE 13-continued

Hydrocarbon emissions of Diesel compared with Diesel + Fuel Supplement - Diesel Examples 1, 2, 3

| Name | Diesel | Diesel + FSDiesel1 | Diesel + FSDiesel2 | Diesel + FSDiesel3 |
|---|---|---|---|---|
| Tetradecane, 4-methyl- | 0 | 80870913 | 73279606 | 0 |
| trans-1,3-Diethylcyclopentane | 0 | 15418790 | 0 | 0 |
| trans-p-mentha-1(7),8-dien-2-ol | 0 | 41425393 | 0 | 0 |
| Undecane, 2,5-dimethyl- | 0 | 12739396 | 12115327 | 0 |
| Benzene, 1,3-dimethyl- | 0 | 0 | 47949202 | 47856000 |
| Carveol | 0 | 0 | 35185370 | 35819595 |
| cyclo[2.2.1]heptan-2-one, 1,7,7-trimethyl-, (1S | 0 | 0 | 50949555 | 60029268 |
| Cyclohexanol, 1-methyl-4-(1-methylethyl)- | 0 | 0 | 21183847 | 0 |
| Heptadecane, 9-hexyl- | 0 | 0 | 22587475 | 0 |
| Heptane, 2,6-dimethyl- | 0 | 0 | 12918278 | 12817722 |
| Hexadecane, 2,6,10,14-tetramethyl- | 0 | 0 | 43907321 | 25824742 |
| Hexadecane, 7-methyl- | 0 | 0 | 15663858 | 0 |
| Hexanoic acid, octadecyl ester | 0 | 0 | 13506778 | 0 |
| Nonadecane, 2-methyl- | 0 | 0 | 10913240 | 0 |
| Octadecane, 3-ethyl-5-(2-ethylbutyl)- | 0 | 0 | 39046053 | 0 |
| Octane, 1-chloro- | 0 | 0 | 24237864 | 23856891 |
| Cyclohexane, 1,4-dimethyl-, trans- | 0 | 0 | 0 | 12977786 |
| Eicosane, 9-cyclohexyl- | 0 | 0 | 0 | 25066776 |
| Hexadecane, 7,9-dimethyl- | 0 | 0 | 0 | 72472075 |
| Levomenthol | 0 | 0 | 0 | 19759934 |
| Pentadecane, 3-methyl- | 0 | 0 | 0 | 15315160 |
| Trichloroacetic acid, hexadecyl ester | 0 | 0 | 0 | 24235898 |
| Tridecane, 7-hexyl- | 0 | 0 | 0 | 20260782 |

Tests were carried out in Government approved, NABL accredited Laboratory and certified by authorized persons.

BRIEF DESCRIPTION OF FIGURES & CHARTS

FIG. 1: Kinematic Viscosity of Diesel compared with Diesel+Fuel Supplement—Diesel Examples 1, 2, 3—Value as in Table 3

Figure 2:
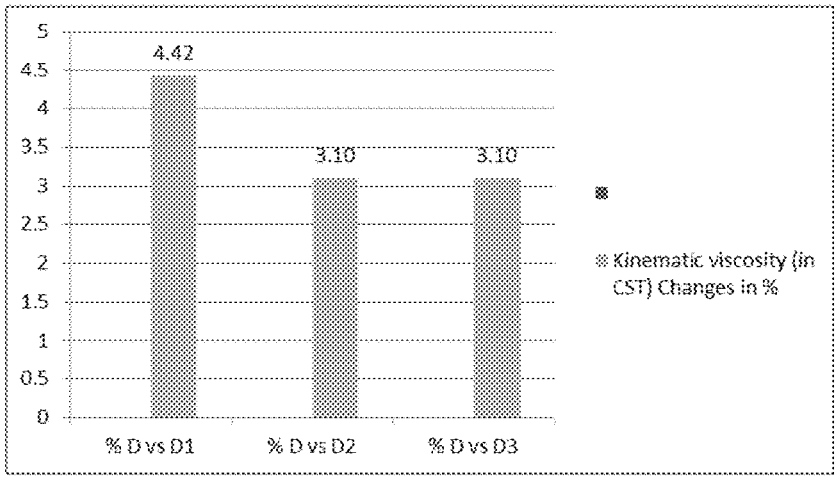
Figure 3:
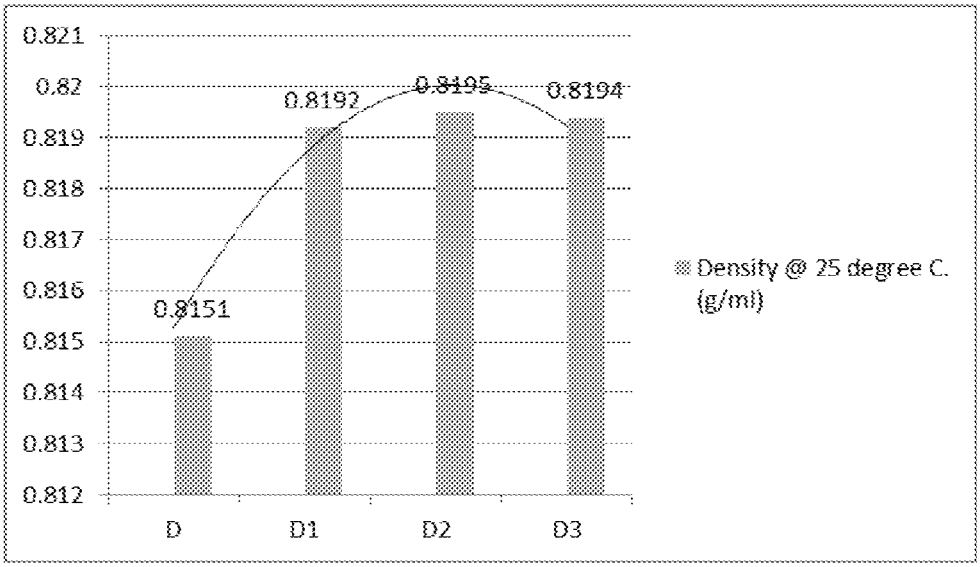

FIG. 2: Kinematic Viscosity of Diesel as compared to Diesel+Fuel Supplement—Diesel Examples 1, 2, 3—% changes FIG. 3: Density of Diesel at 25° C. compared with Diesel+Fuel Supplement-Diesel Examples 1, 2, 3—Value as in Table 3

Figure 4:
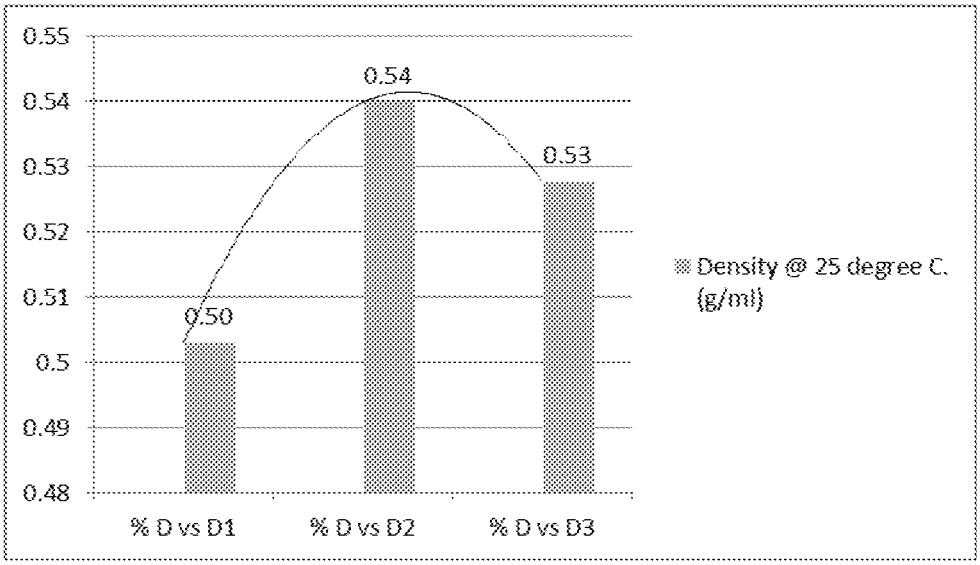
Figure 5:
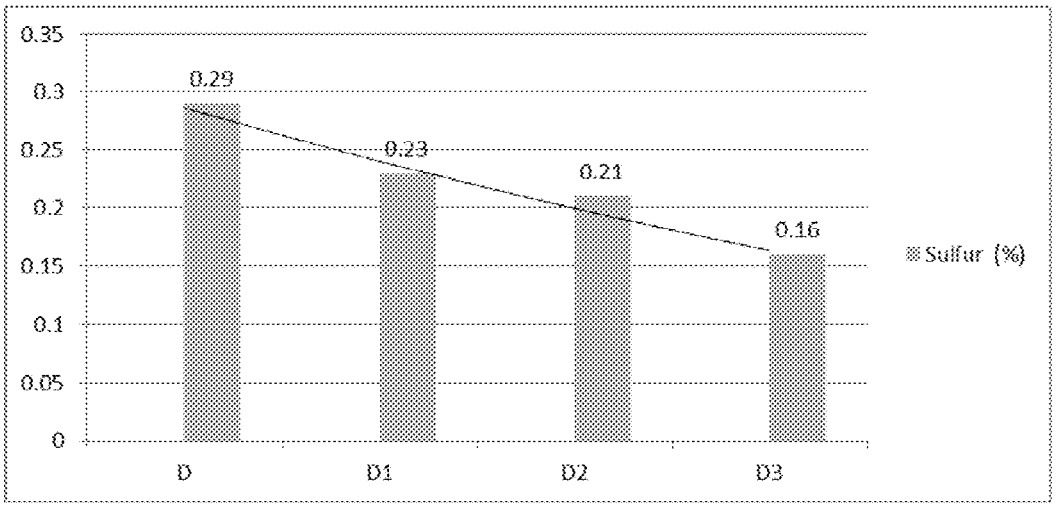

FIG. 4: Density of Diesel at 25° C. compared with Diesel+Fuel Supplement-Diesel Examples 1, 2, 3—% changes FIG. 5: Sulfur Content in Diesel compared with Diesel+Fuel Supplement—Diesel Examples 1, 2, 3—Value as in Table 3

Figure 6:
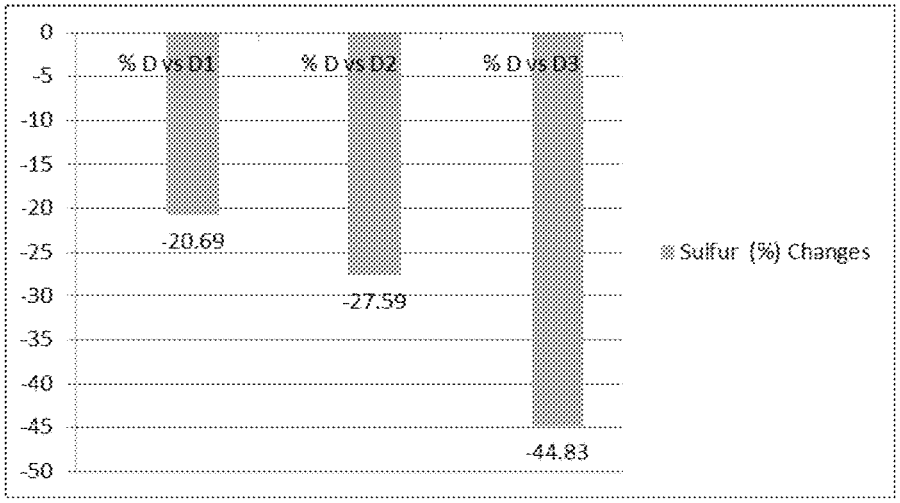
Figure 7:
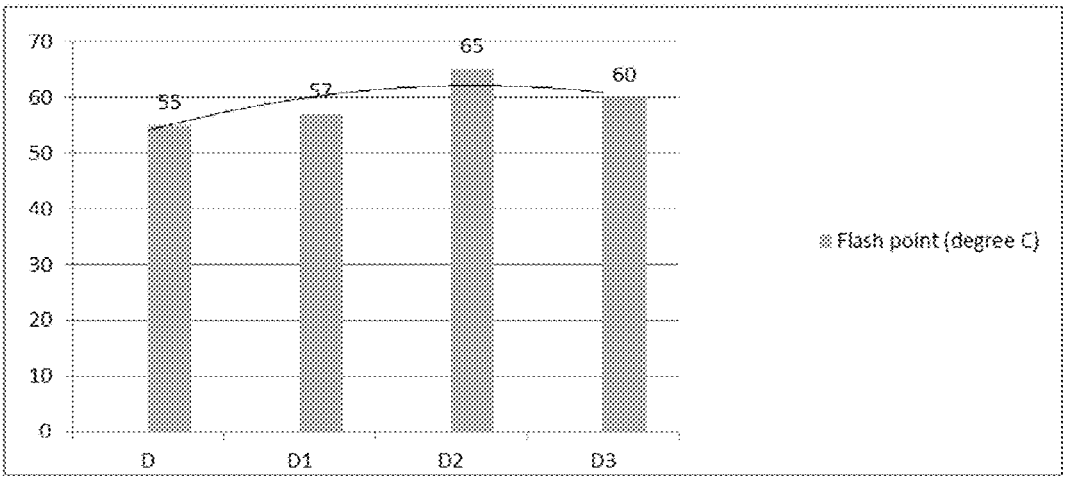

FIG. 6: Sulfur Content in Diesel compared with Diesel+Fuel Supplement—Diesel Examples 1, 2, 3—% changes FIG. 7: Flash Point of Diesel compared with Diesel+Fuel Supplement—Diesel Examples 1, 2, 3—Value as in Table 3

Figure 8:
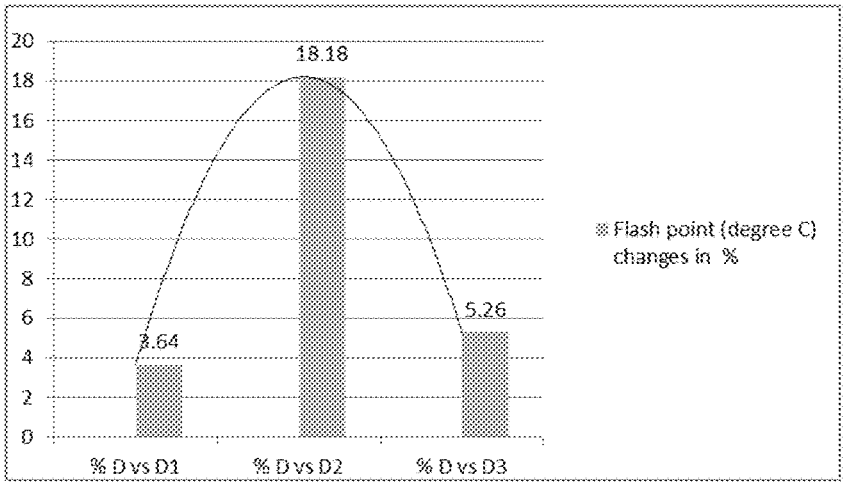
Figure 9:
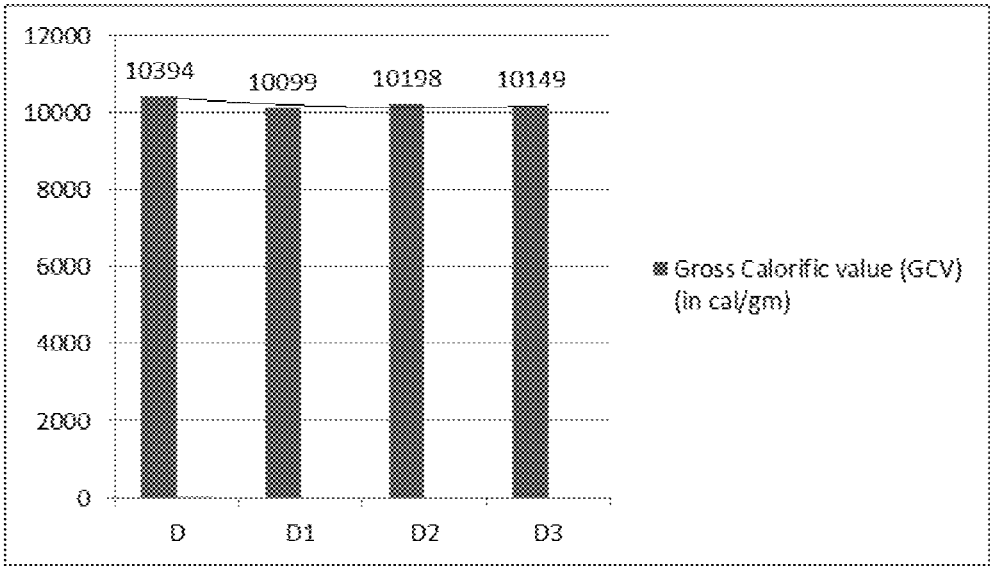

FIG. 8: Flash Point of Diesel compared with Diesel+Fuel Supplement—Diesel Examples 1, 2, 3—% changes FIG. 9: GCV of Diesel compared with Diesel+Fuel Supplement—Diesel Examples 1, 2, 3—Value as in Table 3

Figure 10:
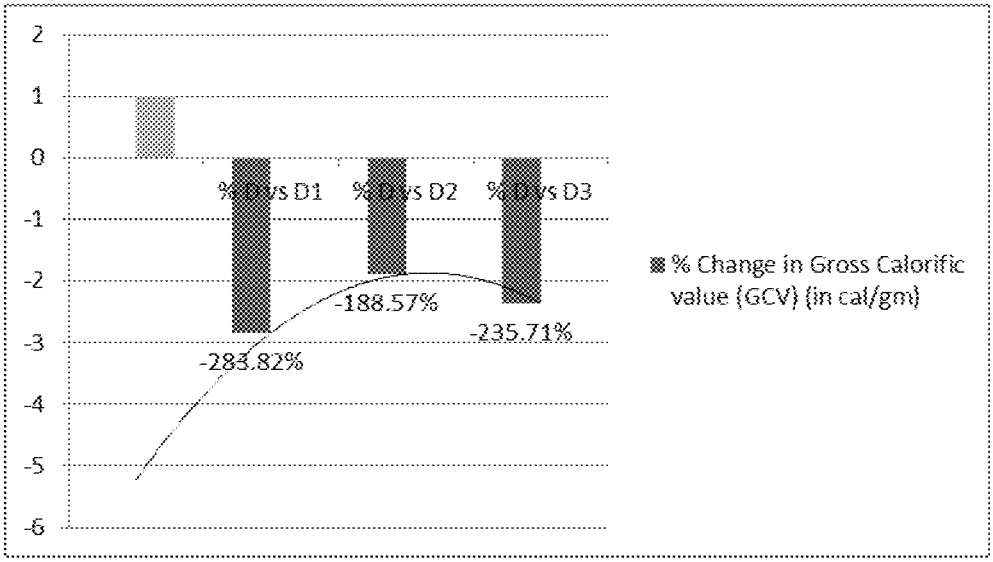
Figure 11:
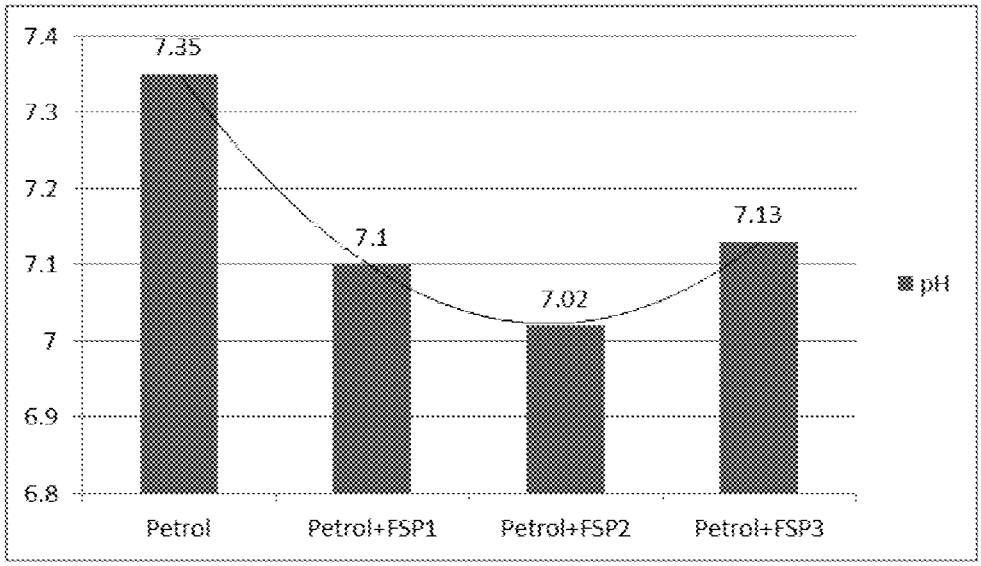

FIG. 10: GCV of Diesel compared with Diesel+Fuel Supplement—Diesel Examples 1, 2, 3—% changes FIG. 11: pH values of Petrol compared with Petrol+Fuel Supplement—Petrol Examples 1, 2, 3—Values as in Table 1

Figure 12:
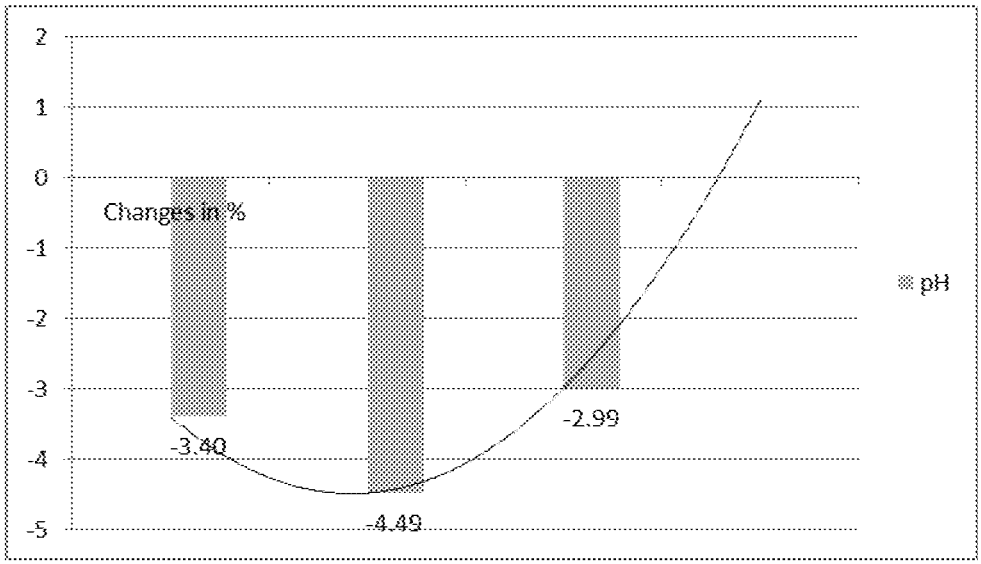
Figure 13:
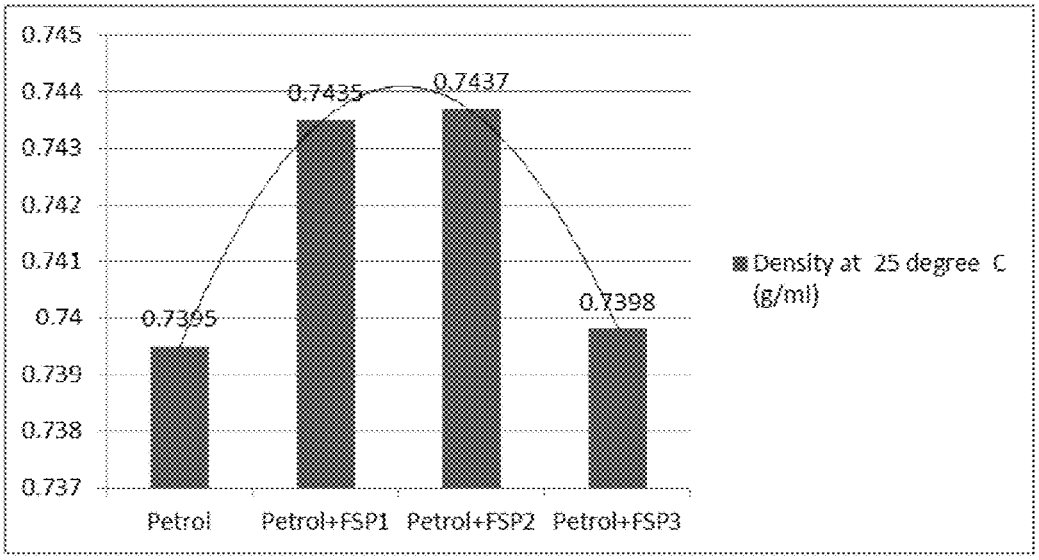

FIG. 12: pH values of Petrol compared with Petrol+Fuel Supplement—Petrol Examples 1, 2, 3—% changes FIG. 13: Density at 25° C. of Petrol compared with Petrol+Fuel Supplement—Petrol Examples 1, 2, 3—Values as in Table 1

Figure 14:
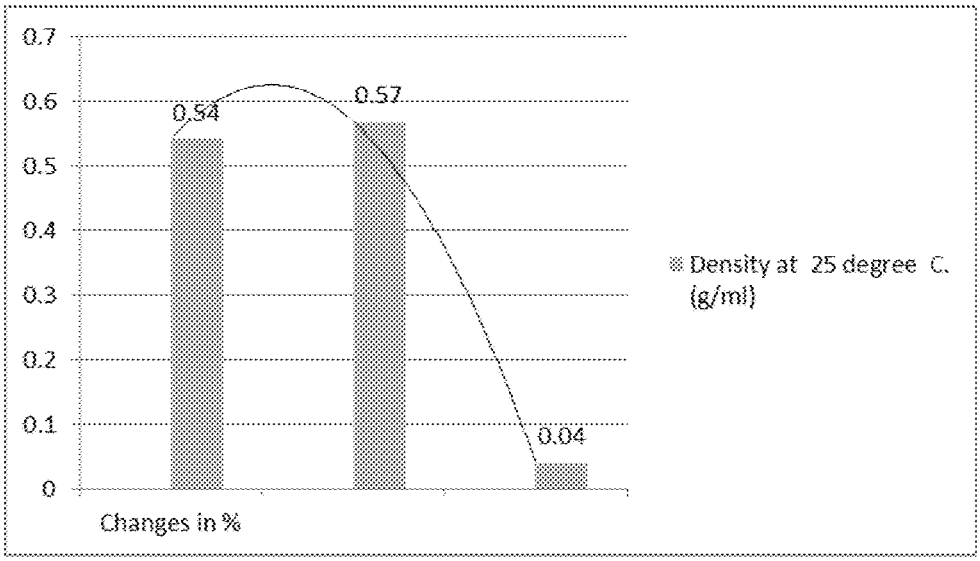
Figure 15:
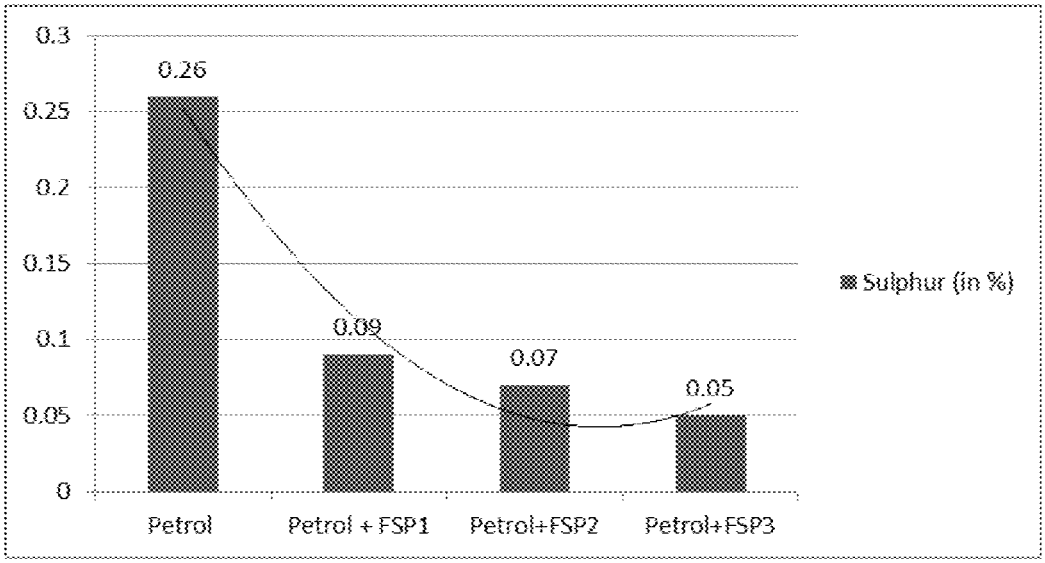

FIG. 14: Density at 25° C. of Petrol compared with Petrol+Fuel Supplement—Petrol Examples 1, 2, 3—% changes FIG. 15: Sulfur % of Petrol compared with Petrol+Fuel Supplement—Petrol Examples 1, 2, 3—Values as in Table 1

Figure 16:
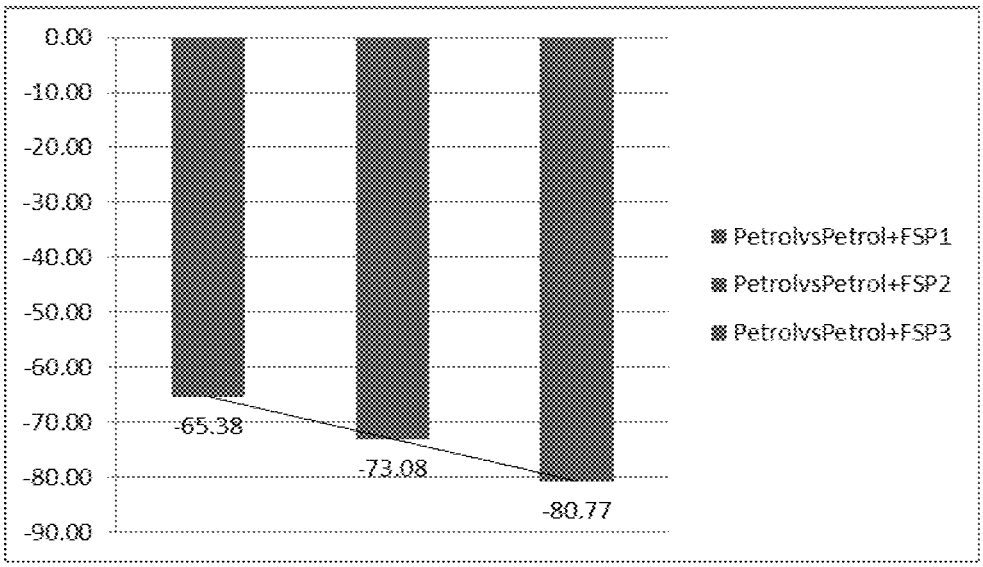
Figure 17:
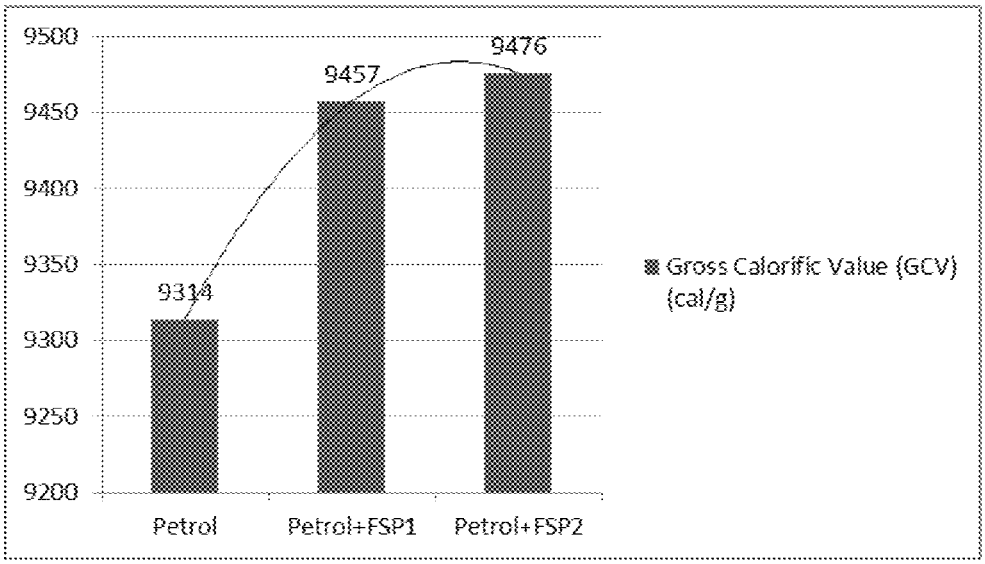

FIG. 16: Sulfur % of Petrol compared with Petrol+Fuel Supplement—Petrol Examples 1, 2, 3—% changes FIG. 17: GCV of Petrol compared with Petrol+Fuel Supplement—Petrol Examples 1, 2, 3—Values as in Table 1

Figure 18:
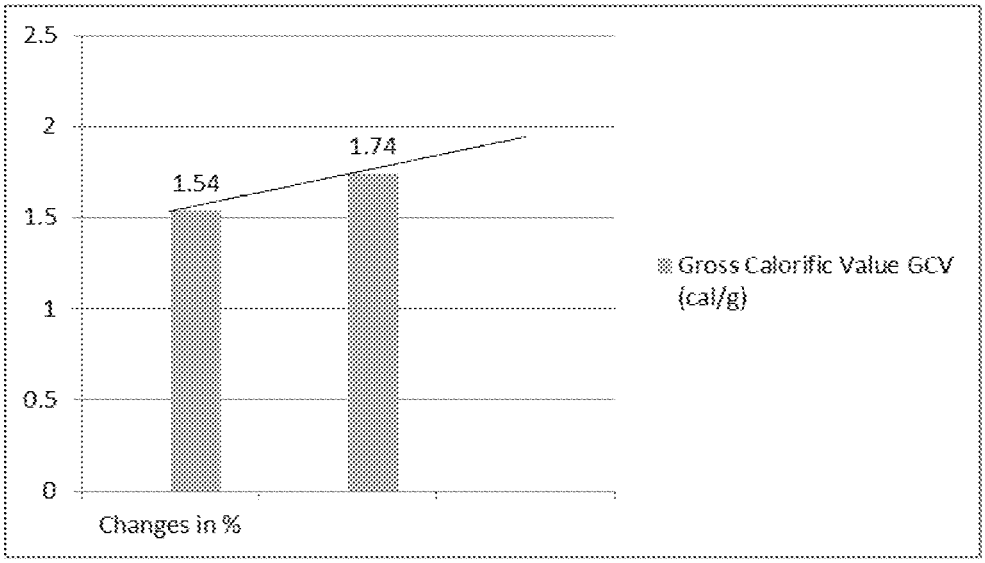

FIG. 18: GCV of Petrol compared with Petrol+Fuel Supplement—Petrol Examples 1, 2, 3—% changes It will be readily apparent to one skilled in the art that varying substitutions and modifications may be made to the invention disclosed herein without departing from the spirit of the invention. Thus, it should be understood that although the present invention has been specifically disclosed by the preferred embodiments and optional features, modification and variation of the concepts herein disclosed may be resorted to by those skilled in the art, and such modifications and variations are considered to be falling within the scope of the invention and therefore should not be construed to limit the scope of the invention.

It is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

We claim:

1. A Fuel Supplement to reduce harmful emissions, for Petrol, which when added to Petrol reduces the Sulfur content in Petrol by 70% to 80% and which comprises:

Dust of Thymol (extracted from *Thymus vulgaris*) in the range of 50 to 125 mg,

Dust of Camphor White (extracted from *Cinnamomum camphora*) in the range of 100 to 180 mg, Dust of Mint (extracted from *Mentha arvensis*) in the range of 130 to 210 mg, Neem Oil (*Azadirachta indica*) in the range of 8 to 22 ml v/v, Banyan Leaf Oil (*Ficus benghalensis*) in the range of 5 to 15 ml v/v Ashoka Leaf Oil (*Saraca asoca*) in the range of 4 to 16 ml v/v, Linseed Oil (*Linum usitatissimum*) in the range of 15 to 25 ml v/v, Clove Oil (*Eugenia cayophyllata*) in the range of 2 to 10 ml v/v, Lemongrass Oil (*Cymbopogan flexuosus*) in the range of 10 to 35 ml v/v, Indian Bay Leaf Oil (*Cinnamomum tamala*) in the range of 1 to 5 ml v/v, Jojoba Oil (*Simmondsia chenesis*) in the range of 40 to 60 ml v/v, Teak Oil (*Tectona grandis*) in the range of 50 to 75 ml v/v, Turmeric Oil (*Curcuma longa*) in the range of 0.5 to 5 ml v/v, Cedarwood Oil (*Cedrus atlantica*) in the range of 1 to 10 ml v/v, Turpentine Oil (*Pinus roxburghii*) in the range of 60 to 100 ml v/v, Coconut Oil (*Cocus nucifera*) in the range of 80 to 100 ml v/v, Sunflower Oil (*Helianthus annus*) in the range of 30 to 80 ml v/v, Peepal Leaf oil (*Ficus religiosa*) in the range of 35 to 50 ml v/v, Basil Leaf Oil (*Ocimum basilicum*) in the range of 1 to 9 ml v/v, White Cedar Leaf Oil (*Thuja occidentalis*) in the range of 10 to 30 ml v/v, Lemon *Eucalyptus* Oil (*Corymbia citriodora*) in the range of 0.5 to 3.5 ml v/v, Sheesham Oil (*Dalbergia sissoo*) in the range of 15 to 27 ml v/v, Olive Oil (*Olea europaea*) in the range of 50 to 70 ml v/v, Key Lime Oil (*Citrus aurantifolia*) in the range of 6 to 12 ml v/v, Khella Oil (*Ammi visagna*) in the range of 10 to 18 ml v/v, and Indian Bael Leaf Oil (*Aegle marmelos*) in the range of 15 to 20 ml v/v.

2. A process of preparing the Fuel Supplement to reduce harmful emissions, for Petrol, according to claim 1, which comprises of steps:

a) Mixing Dust of Thymol (extracted from *Thymus vulgaris*) in the range of 50 to 125 mg, Dust of Camphor White (extracted from *Cinnamomum camphora*) in the range of 100 to 180 mg and Dust of Mint (extracted from *Mentha arvensis*) in the range of 130 to 210 mg in 100 ml of Petrol, and b) Adding of following oils in given order to the above prepared mixture Neem Oil (*Azadirachta indica*) in the range of 8 to 22 ml v/v, Banyan Leaf Oil (*Ficus benghalensis*) in the range of 5 to 15 ml v/v, Ashoka Leaf Oil (*Saraca asoca*) in the range of 4 to 16 ml v/v, Linseed Oil (*Linum usitatissimum*) in the range of 15 to 25 ml v/v, Clove Oil (*Eugenia cayophyllata*) in the range of 2 to 10 ml v/v, Lemongrass Oil (*Cymbopogan flexuosus*) in the range of 10 to 35 ml v/v, Indian Bay Leaf Oil (*Cinnamomum tamala*) in the range of 1 to 5 ml v/v, Jojoba Oil (*Simmondsia chenesis*) in the range of 40 to 60 ml v/v, Teak Oil (*Tectona grandis*) in the range of 50 to 75 ml v/v, Turmeric Oil (*Curcuma longa*) in the range of 0.5 to 5 ml v/v, Cedarwood Oil (*Cedrus atlantica*) in the range of 1 to 10 ml v/v, Turpentine Oil (*Pinus roxburghii*) in the range of 60 to 100 ml v/v, Coconut Oil (*Cocus nucifera*) in the range of 80 to 100 ml v/v, Sunflower Oil (*Helianthus annus*) in the range of 30 to 80 ml v/v, Peepal Leaf oil (*Ficus religiosa*) in the range of 35 to 50 ml v/v, Basil Leaf Oil (*Ocimum basilicum*) in the range of 1 to 9 ml v/v, White Cedar Leaf Oil (*Thuja occidentalis*) in the range of 10 to 30 ml v/v, Lemon *Eucalyptus* Oil (*Corymbia citriodora*) in the range of 0.5 to 3.5 ml v/v, Sheesham Oil (*Dalbergia sissoo*) in the range of 15 to 27 ml v/v, Olive Oil (*Olea europaea*) in the range of 50 to 70 ml v/v, Key Lime Oil (*Citrus aurantifolia*) in the range of 6 to 12 ml v/v, Khella Oil (*Ammi visagna*) in the range of 10 to 18 ml v/v, Indian Bael Leaf Oil (*Aegle marmelos*) in the range of 15 to 20 ml v/v, to make 1000 ml of the Fuel Supplement, by stirring and maintaining the temperature between 16 to 24° C.;

c) Filtering the Fuel Supplement;

d) Warming the Fuel Supplement in a closed metallic container in water at temperature of 40 to 60° C., for 60 to 90 minutes;

e) Cooling the Fuel Supplement without stirring to temperature of 16 to 24° 24° C. for 45 to 60 minutes; and f) Filtering the Fuel Supplement and packing in aluminium or amber coloured glass bottles.

3. A Fuel Supplement to reduce harmful emissions, for Diesel, which when added to Diesel reduces the Sulfur content by 40% to 50% wherein said Fuel Supplement comprises:

Crystalline Thymol (extracted from *Thymus vulgaris*) in the range 40 to 60 mg,

Crystalline Mint (extracted from *Mentha arvensis*) in the range of 200 to 260 mg, Crystalline Camphor (*Cinnamomum camphora*) in the range of 125 to 156 mg, Cedarwood Oil (*Cedrus atlantica*) in the range of 18 to 26 ml v/v, Banyan Leaf Oil (*Ficus benghalensis*) in the range of 15 to 30 ml v/v, Turpentine Oil (*Pinus roxburghii*) in the range of 32 to 52 ml v/v, Groundnut Oil (*Arachis hypogaea*) in the range of 16 to 22 ml v/v, Liquid Paraffin Oil in the range of 17 to 30 ml v/v, Linseed Oil (*Linum usitatissimum*) in the range of 7 to 16 ml v/v, Indian Bay Leaf Oil (*Cinnamomum tamala*) in the range of 60 to 75 ml v/v, Clove Oil (*Eugenia cayophyllata*) in the range of 25 to 35 ml v/v, Khella Oil (*Ammi visagna*) in the range of 50 to 72 ml v/v, Indian Bael Leaf Oil (*Aegle marmelos*) in the range of 9 to 20 ml v/v, Key Lime Oil (*Citrus aurantifolia*) in the range of 2 to 6 ml v/v, Jojoba Oil (*Simmondsia chenesis*) in the range of 5 to 6.5 ml v/v, Olive Oil (*Olea europaea*) in the range of 40 to 56 ml v/v, Teak Oil (*Tectona grandis*) in the range of 29 to 42 ml v/v, Sheesham Oil (*Dalbergia sissoo*) in the range of 7 to 10 ml v/v, Sunflower Oil (*Helianthus annus*) in the range of 9 to 21 ml v/v,

*Eucalyptus* Oil (*Corymbia citriodora*) in the range of 35 to 50 ml v/v,

Lemongrass Oil (*Cymbopogan citratus*) in the range of 20 to 38 ml v/v,

Basil Leaf Oil (*Ocimum basilicum*) in the range of 50 to 62 ml v/v,

White Cedar Leaf Oil (*Thuja occidentalis*) in the range of 24 to 32 ml v/v, and Turmeric Oil (*Curcuma longa*) in the range of 20 to 28 ml v/v.

4. The process of preparing the Fuel Supplement according to claim 3 wherein said process comprises the steps of:

a) Mixing Crystalline Thymol in the range of 40 to 60 mg, Crystalline Mint in the range of 200 to 260 mg and Crystalline Camphor in the range of 125 to 156 mg in 100 ml of Diesel;

b) Adding of above mentioned oils in given order;

Cedarwood Oil (*Cedrus atlantica*) in the range of 18 to 26 ml v/v,

Banyan Leaf Oil (*Ficus benghalensis*) in the range of 15 to 30 ml v/v,

Turpentine Oil (*Pinus roxburghii*) in the range of 32 to 52 ml v/v,

Groundnut Oil (*Arachis hypogaea*) in the range of 16 to 22 ml v/v,

Liquid Paraffin Oil in the range of 17 to 30 ml v/v,

Linseed Oil (*Linum usitatissimum*) in the range of 7 to 16 ml v/v,

Indian Bay Leaf Oil (*Cinnamomum tamala*) in the range of 60 to 75 ml v/v,

Clove Oil (*Eugenia cayophyllata*) in the range of 25 to 35 ml v/v,

Khella Oil (*Ammi visagna*) in the range of 50 to 72 ml v/v,

Indian Bael Leaf Oil (*Aegle marmelos*) in the range of 9 to 20 ml v/v,

Key Lime Oil (*Citrus aurantifolia*) in the range of 2 to 6 ml v/v,

Jojoba Oil (*Simmondsia chenesis*) in the range of 5 to 6.5 ml v/v,

Olive Oil (*Olea europaea*) in the range of 40 to 56 ml v/v,

Teak Oil (*Tectona grandis*) in the range of 29 to 42 ml v/v,

Sheesham Oil (*Dalbergia sissoo*) in the range of 7 to 10 ml v/v,

Sunflower Oil (*Helianthus annus*) in the range of 9 to 21 ml v/v,

*Eucalyptus* Oil (*Corymbia citriodora*) in the range of 35 to 50 ml v/v,

Lemongrass Oil (*Cymbopogan citratus*) in the range of 20 to 38 ml v/v

Basil Leaf Oil (*Ocimum basilicum*) in the range of 50 to 62 ml v/v,

White Cedar Leaf Oil (*Thuja occidentalis*) in the range of 24 to 32 ml v/v, and Turmeric Oil (*Curcuma longa*) in the range of 20 to 28 ml v/v, to the above prepared mixture, to make 1000 ml of the Fuel Supplement, by gentle stirring and maintaining the temperature between 18 to 24° C. [24° C.];

c) Filtering the Fuel Supplement to remove any impurities or particulate matter;

d) Warming the Fuel Supplement in a closed metallic container in water at temperature of 40 to 60° C., for 45 to 90 minutes;

e) Cooling the Fuel Supplement without stirring to temperature of 16 to 24° C. for 45 to 60 minutes; and f) Filtering the Fuel Supplement and packing in aluminium or amber coloured glass bottles.

5. The Fuel Supplement to reduce harmful emissions, as claimed in claim 1, which is added to an automotive fuel in the ratio of 10 ml to 12 ml per 1000 ml of Petrol.

6. The Fuel Supplement to reduce harmful emissions, as claimed in claim 3, which is added to an automotive fuel in the ratio of 13 ml to 15 ml per 1000 ml of Diesel.

7. The Fuel Supplement to reduce harmful emissions, as claimed in claim 1, which when added to Petrol reduces the pollution and emissions from a vehicle by 70% to 80%.

8. The Fuel Supplement to reduce harmful emissions, as claimed in claim 3, which when added to Diesel reduces the engine temperature by 5 to 10%.

9. The Fuel Supplement according to claim 3 which when added to diesel reduces the pollution and emissions from the vehicle by 70% to 80%.

* * * * *